US010143262B2

(12) United States Patent
Harml et al.

(10) Patent No.: US 10,143,262 B2
(45) Date of Patent: Dec. 4, 2018

(54) ANTI-STATIC SPORTS EQUIPMENT, SPORTS SYSTEM HAVING AN ANTI-STATIC FUNCTION AND SPORTS CLOTHING SYSTEM FOR A SPORTS SYSTEM

(71) Applicants: Markus Harml, Radstadt (AT); Huber Ski-Con KG, Radstadt (AT)

(72) Inventors: Markus Harml, Radstadt (AT); Rupert Huber, Radstadt (AT)

(73) Assignees: Markus HARML, Radstadt (AT); Huber Ski-Con KG, Radstadt (AT)

( * ) Notice: Subject to any disclaimer, the term of this patent is extended or adjusted under 35 U.S.C. 154(b) by 136 days.

(21) Appl. No.: 15/109,470

(22) PCT Filed: Nov. 26, 2014

(86) PCT No.: PCT/AT2014/050280

§ 371 (c)(1),
(2) Date: Jul. 8, 2016

(87) PCT Pub. No.: WO2015/100463

PCT Pub. Date: Jul. 9, 2015

(65) Prior Publication Data

US 2016/0324258 A1 Nov. 10, 2016

(30) Foreign Application Priority Data

Jan. 2, 2014 (AT) ..... A 50002/2014
Jul. 18, 2014 (AT) ..... A 50503/2014

(51) Int. Cl.
*A43B 7/36* (2006.01)
*A63C 5/12* (2006.01)
(Continued)

(52) U.S. Cl.
CPC ..... *A43B 7/36* (2013.01); *A41D 13/0015* (2013.01); *A41D 13/02* (2013.01); *A41D 19/015* (2013.01);
(Continued)

(58) Field of Classification Search
CPC ..... A41B 11/00; A41D 31/0066; A43B 7/36; A61N 1/14
See application file for complete search history.

(56) References Cited

U.S. PATENT DOCUMENTS 318,172 A * 5/1885 Delany ..... A43B 7/36 174/5 SB
2,162,888 A * 6/1939 Held ..... A63C 7/04 280/604
(Continued)

FOREIGN PATENT DOCUMENTS

CN 201541805 U 8/2010
DE 2 147 904 A 3/1973
(Continued)

OTHER PUBLICATIONS

International Search Report of PCT/AT2014/050280, dated Aug. 3, 2015.

*Primary Examiner* — James A Shriver, II
*Assistant Examiner* — Brian L Cassidy
(74) *Attorney, Agent, or Firm* — Collard & Roe, P.C.

(57) ABSTRACT

An antistatic sport device includes a basic body and a basic element placed at the basic body, made of a running surface layer and side edges. At least one of the side edges forms a contacting surface that can be turned towards the terrain. Between a rear surface of the running surface layer and the basic body, a contacting element made of an electrically conductive material is placed at least in sections. The running surface layer is electrically conductively connected to the contacting element via a discharge path and further the
(Continued)

Figure 1:
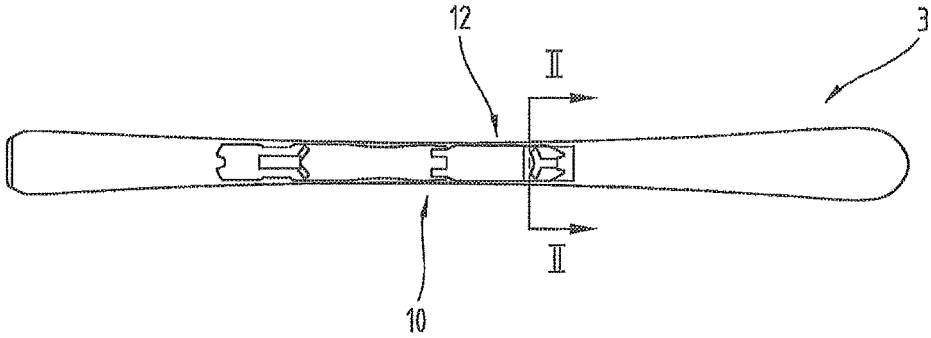

contacting element to the contacting surface formed by the at least one side edge. Further, a sport system has antistatic function and a sport clothing system is for such sport system.

32 Claims, 17 Drawing Sheets

(51) Int. Cl.

| | |
|---|---|
| ***A43B 5/04*** | (2006.01) |
| ***A41D 13/00*** | (2006.01) |
| ***A41D 13/02*** | (2006.01) |
| ***A41D 19/015*** | (2006.01) |
| ***A41D 31/00*** | (2006.01) |
| ***A42B 3/06*** | (2006.01) |
| ***A42B 3/18*** | (2006.01) |
| ***A43B 3/00*** | (2006.01) |
| ***A43B 5/00*** | (2006.01) |
| ***A43B 17/00*** | (2006.01) |
| ***A43B 23/07*** | (2006.01) |
| ***A43C 15/06*** | (2006.01) |

(52) U.S. Cl.
CPC ..... *A41D 31/0066* (2013.01); *A42B 3/061* (2013.01); *A42B 3/185* (2013.01); *A43B 3/0005* (2013.01); *A43B 5/002* (2013.01); *A43B 5/04* (2013.01); *A43B 5/0411* (2013.01); *A43B 5/0496* (2013.01); *A43B 17/003* (2013.01); *A43B 23/07* (2013.01); *A43C 15/068* (2013.01); *A63C 5/12* (2013.01); *A63C 2203/12* (2013.01)

(56) References Cited

U.S. PATENT DOCUMENTS 2,279,094 A * 4/1942 Siers ..... A43B 7/36 361/224
2,712,099 A * 6/1955 Legge ..... A43B 7/36 36/1
2,765,373 A * 10/1956 Smith ..... G02C 11/06 381/327
2,904,724 A * 9/1959 Mendoza ..... A43B 7/36 361/224
3,293,494 A * 12/1966 Fischer ..... A43B 7/36 12/147 R
3,317,650 A * 5/1967 Padellford ..... H01R 4/64 174/5 SB
3,498,626 A * 3/1970 Sullivan ..... A63C 5/12 156/286
3,541,389 A * 11/1970 Van Name ..... A43B 7/36 174/5 R
3,544,841 A * 12/1970 Peel ..... A43B 7/36 361/224
3,596,134 A * 7/1971 Burke ..... A43B 1/0054 2/161.6
4,360,218 A * 11/1982 Spademan ..... A63C 9/088 280/611
4,415,626 A * 11/1983 Hasenauer ..... G03C 1/85 428/323
4,741,333 A * 5/1988 Suzuki ..... A41D 13/1209 128/201.23
4,769,856 A * 9/1988 Reed ..... A41D 19/00 2/167
5,056,807 A * 10/1991 Comert ..... A63C 5/12 280/610
5,160,158 A * 11/1992 Scherubl ..... A63C 5/003 280/610
5,271,640 A * 12/1993 Potochick ..... A63C 11/22 280/816
5,372,370 A * 12/1994 Rohrmoser ..... A63C 5/12 280/602
5,448,840 A * 9/1995 Cheskin ..... A43B 7/36 36/32 R
5,653,047 A * 8/1997 Franey ..... A43B 7/36 36/136
5,687,983 A * 11/1997 Feketa ..... A63C 5/003 280/608
5,991,922 A 11/1999 Banks
6,147,854 A * 11/2000 Kirschner ..... A41D 13/008 361/212
6,338,162 B1 * 1/2002 Geng ..... A41D 19/015 2/161.6
6,349,961 B1 * 2/2002 Colley ..... B29C 45/14467 280/14.22
6,767,603 B1 * 7/2004 Hurst ..... A41D 13/008 2/69
7,232,243 B1 * 6/2007 Nassif ..... A63C 5/06 362/249.04
7,471,497 B1 * 12/2008 Knight, Sr. ..... A43B 7/36 361/212
7,869,183 B1 * 1/2011 Tan ..... A41D 13/008 361/212
7,900,272 B1 * 3/2011 Tan ..... A41D 13/008 2/69
7,997,014 B2 * 8/2011 Righetto ..... A43B 7/36 36/24.5
8,414,343 B2 4/2013 Stoughton
9,366,404 B1 * 6/2016 Porter ..... A63C 13/00
2002/0089805 A1 * 7/2002 Maritz ..... A43B 7/36 361/224
2006/0175581 A1 * 8/2006 Douglas ..... A41D 31/0066 252/500
2006/0287126 A1 * 12/2006 Aisenbrey ..... A01K 87/00 473/316
2007/0000155 A1 * 1/2007 Laufer ..... A43B 7/36 36/136
2007/0080518 A1 * 4/2007 Carvajal ..... A63C 9/0802 280/611
2007/0271689 A1 * 11/2007 Baldwin ..... A41D 13/008 2/456
2008/0083721 A1 * 4/2008 Kaiserman ..... A43B 3/0005 219/211
2008/0289217 A1 * 11/2008 Horvath ..... A43B 3/108 36/88
2009/0032517 A1 2/2009 Sopuch et al.
2009/0066073 A1 * 3/2009 Kawano ..... A63C 5/003 280/816
2009/0178179 A1 * 7/2009 Liu ..... A41B 11/00 2/239
2009/0290279 A1 * 11/2009 Rodgriguez ..... A61N 1/14 361/220
2010/0003508 A1 * 1/2010 Arrouy ..... G02B 1/105 428/336
2010/0083429 A1 * 4/2010 Carraro ..... A41D 13/008 2/456
2010/0148457 A1 * 6/2010 Holzer ..... A63C 5/07 280/11.3
2011/0012319 A1 1/2011 Kuczynski et al.
2012/0034830 A1 2/2012 Stoughton
2013/0134691 A1 * 5/2013 Holzer ..... A63C 7/02 280/604
2013/0247288 A1 * 9/2013 Kotos ..... A41D 31/0055 2/463
2013/0298319 A1 * 11/2013 Schlager ..... A41D 13/008 2/456
2014/0244071 A1 * 8/2014 Czaja ..... A43B 3/0005 701/2
2014/0318699 A1 * 10/2014 Longinotti-Buitoni ..... A61B 5/0002 156/247
2016/0001163 A1 * 1/2016 Devaux ..... A63C 9/0802 280/633

(56) References Cited

U.S. PATENT DOCUMENTS

| | | | | |
|---|---|---|---|---|
| 2016/0033970 | A1* | 2/2016 | Henderson | B60L 13/04 701/22 |
| 2017/0188640 | A1* | 7/2017 | Schlager | A41D 13/008 |
| 2017/0196513 | A1* | 7/2017 | Longinotti-Buitoni | A61B 5/6804 |

FOREIGN PATENT DOCUMENTS

| | | | |
|---|---|---|---|
| DE | 297 00 693 | U1 | 4/1997 |
| DE | 102 55 408 | A1 | 7/2004 |
| DE | 10 2010 022 729 | A1 | 12/2011 |
| EP | 2 005 851 | B1 | 12/2008 |
| GB | 2 320 669 | A | 7/1998 |
| GB | 2 402 061 | A | 12/2004 |
| IT | 1 257 677 | B | 2/1996 |
| JP | H09 313662 | A | 12/1997 |
| JP | 2000 312601 | A | 11/2000 |
| JP | 2003 052429 | A | 2/2003 |
| WO | 98/25492 | A1 | 6/1998 |
| WO | 2008/044965 | A1 | 4/2008 |

* cited by examiner

ANTI-STATIC SPORTS EQUIPMENT, SPORTS SYSTEM HAVING AN ANTI-STATIC FUNCTION AND SPORTS CLOTHING SYSTEM FOR A SPORTS SYSTEM

CROSS REFERENCE TO RELATED APPLICATIONS

This application is the National Stage of PCT/AT2014/050280 filed on Nov. 26, 2014, which claims priority under 35 U.S.C. § 119 of Austrian Application Nos. A 50002/2014 filed on Jan. 2, 2014, and A 50503/2014 filed on Jul. 18, 2014, the disclosures of which are incorporated by reference. The international application under PCT article 21(2) was not published in English.

The invention refers to a sport system, a sport clothing system for the sport system as well as a sport device for the sport system, each with an antistatic function, as described herein.

DE 2 147 904 A describes an antistatic running shoe in which an electrically conductive, nonfading resistor material is integrated from the foot support level in the shoe through all layers of the sole up to direct contact with the ground. The material integrated into the sole can be a plastic that has been rendered electrically conductive, or a natural product that has been rendered electrically conductive accordingly, or an electrically conductive cell polyurethane. Preferably, a cellular polyurethane elastomer sealed with a soot-plastic dispersion is used, with the cell structure kept to prevent water absorption. This enables earthing the body of a user of such an antistatic running shoe even on modern sport facilities such as artificial turf or synthetic running tracks that are subject to discharge particularly strong electrostatic charging by friction electricity from "foot-floor contact" due to the movement rhythm.

Another shoe, in particular a safety shoe or leisure shoe, with an antistatic function has been disclosed in EP 2 005 851 B1. It comprises a sole with a foot support and an outer sole area, with the foot support being formed of one plastic piece with the sole. Furthermore, at least one continuous channel is provided from the foot support to the outer sole area, and filled with an electrically conductive material. The electrically conductive material is insert-molded or transfused in the channel.

DE 297 00 693 U1 describes an electrostatic discharge device for the human body. The discharge device comprises an outer electrode formed in the tread of the shoe. Furthermore, an inner electrode is provided, with the inner electrode galvanically connected to the outer electrode for discharge. This way, the inner electrode can be placed in the standing area of the shoe, preferably in the area of the heel. The outer electrode is also preferably placed in the area of the heel, and the galvanic connection may also be spring-elastically formed.

An additional earthing of the human body by conductive shoes, socks and stockings is described in DE 102 55 408 A1. Here, it is intended that the shoes are to have wholly or partially conductive soles and wholly or partially conductive insoles. In these soles or insoles, non-insulated conductors are embedded. Conductive threads or conductive sections of woven fabrics are also braided into the foot soles of the socks and stockings. This permits discharge of the electrostatic charge based on the foot of the user that is held in the shoe through the electrical contact with the ground produced in this manner.

In the clothing used today, and the mostly insulating footwear, a high electrostatic charge of the body cannot be prevented. Therefore use of sport systems with which the user is connected via a shoe, in particular a sport shoe, to the sport device, does not permit discharge of the electrostatic charge and thus potential equalization with the ground. Grounding restores the natural electrical basic condition of the body and maintains it. This grounded electrical basic condition in turn promotes health and performance in everyday life. In the past, people walked on the earth, ate and slept on it, with the skin of their bodies touching the earth and thus achieving the natural electrostatic potential equalization. Because mostly insulating shoes with plastic soles are worn today and people sleep in insulating materials in raised beds, the human skin, in particular the naked feet with their widely branched nerve endings, only very rarely touch the ground. This contact usually causes the body to adjust to the energy level or energy potential of the earth at once. Grounding leads to or causes many different reactions in the body. For example, the symptoms of many inflammatory diseases can be reduced or entirely removed. Furthermore, chronic pain can be reduced or removed, the energy level increased and the natural body rhythm regulated. An accelerated healing process and accelerated regeneration after intensive athletic activity can be achieved as well. Additionally, the blood pressure can be regulated or improved and the blood's viscosity reduced.

This invention solves the task of providing a sport system that permits potential equalization from the user using the sport system to the ground. However, it is also to create a sport clothing system for the sport system and/or in particular an antistatically formed sport device for the sport system, each of which also permit potential equalization.

One task of the invention can be solved by the characteristics disclosed herein. The benefit achieved by the characteristics disclosed herein is in that sport devices that already permit grounding and thus discharge of electrostatic charges in the scope of their use during sports can be created this way. The electrostatic charge produced by friction, in particular terrain friction and/or air friction, while riding can be discharged at once by this, without being conducted to the user. The always-possible potential equalization thus avoids interfering electrostatic fields around the sport device. Immediate discharge also reduces the additional air resistance produced by the electrostatic fields or even avoids it entirely. Thus, the strength of the running surface layer can also be influenced or increased better this way, since the contacting element or elements placed additionally in the sport device permit secure discharge from the running surface layer to the contacting surface formed by at least one side edge.

Another embodiment disclosed herein is also of benefit, since this not only creates impeccable adhesion and connection between the running surface layer and the contacting element but also impeccable discharge of the electrostatic charge.

A further embodiment disclosed herein permits creating a possibility for discharging electrostatic charges directly and without any additional components or layers behind the running surface layer on the one hand, and on the other hand doing this on the direct path via a connection to the side edges.

Further, an embodiment disclosed herein is of benefit, since this permits creating a completely electrically conductive outer layer or outer circumference of the sport device across the cross-section in combination with the running surface layer as well. Additionally, this also already permits producing an electrical contact of a binding unit placed at or attached to a sport device via the outer electrically conductive layer to the contacting surfaces of the side edges when attachment means are screwed in.

A further embodiment disclosed herein permits simply creating another electrical contacting option at and/or within the board-like sport device in addition to the outer electrically conductive layer in the attachment area for the coupling device, which can be implemented easily and without any protruding parts at the sport device. For example, this permits implementing another conductive connection to the contacting surface by connection of the coupling device using the intended connection elements. Additionally, the application element can also serve to reinforce the attachment area of the coupling device at the sport device.

Another task of the invention is also solved by the characteristics disclosed herein, however. The benefit achieved by these characteristics is in permitting permanent electrical contact via the continuous electrical contact from the skin surface of the foot to the terrain and thus the earth potential for the user even when using a sport device in combination with a shoe equipped for this now. By providing at least one contacting surface at the sport device, a user of such a sport system can always discharge a static charge to the ground via this electrically conductive connection. Today, the clothing industry uses mostly materials that will cause the user to charge to a higher charge potential than the ground due to the connected static charge while wearing them. To improve the health and performance of the user, this continually electrically conductively formed sport system permits potential equalization at all times, as well as permitting the desired discharge immediately when doing sports.

A further embodiment disclosed herein is also of benefit, since it enables the user to discharge the electrostatic charge to the ground immediately even when using many different board-like sport devices, which reduces the influences from electrostatic charge on the body or removes them altogether.

Further, an embodiment disclosed herein is of benefit, since this permits using already-present components for the board-like sport device while permitting potential equalization by a corresponding electrically conductive connection to the first contact element of the shoe. This way, additional components to form the contacting surface are not needed.

A further embodiment disclosed herein permits using an also already-present part of the sport device for forming the contacting surface. This will often be the case when no side edge formed of electrically conductive material is present. Since the running surface layer forms the contacting surface or contacting surfaces at least in partial areas or sections, the sport device can be in contact with the terrain even across a larger area ratio.

According to another embodiment disclosed herein, it is made possible to connect or couple the shoe to the sport device in use with a coupling device in board-like sport devices, which is done through dedicated, usually screw-shaped or screw-like connection elements. This permits safe attachment of the coupling device to the sport device.

A further development disclosed herein is also of benefit, since the connection element can thus also be used as an electrically conductive transfer element in certain applications. Already-present and common components can be used in this case as well.

In the design according to another embodiment, it is of benefit that a simple electrically conductive connection within the sport device can be created between the contacting surfaces of board-like sport devices and the attachment element or elements.

A further development disclosed herein permits creating a simple electrically conductive connection in the coupled position of the shoe at the coupling device and thus a continuous electrically conductive connection between the inside of the shoe and the contacting surface. This way, only few additional components are needed, which achieves a simple and cost-efficient production of the sport system.

A further embodiment disclosed herein permits simple creation of an electrical contacting option in the attachment area for the coupling device at and/or within the board-like sport device, which can be implemented easily and without any protruding parts at the sport device. For example, the connection process of the coupling device to the intended connection elements can already implement the corresponding conductive connection. Additionally, the application element can also serve to reinforce the attachment area of the coupling device at the sport device.

A further embodiment disclosed herein is also of benefit, since it also permits creating a secure and continuous electrically conductive connection at the coupling device at a pre-defined location in correspondence with the first contact element placed on the shoe.

According to another embodiment disclosed herein, this creates a secure, electrically conductive connection in the area of the sport devices when the coupling device is placed on it.

A further embodiment disclosed herein is of benefit for this, since, for the greatest part, already-present parts which can be connected among and to each other by the corresponding alignment and formation of the electrically conductive connection, can be used. Thus, in turn, it is possible to create a continuous electrically conductive connection simply and without a great number of additional parts.

According to a beneficial further development disclosed herein, this creates the option of forming a direct electrical contact between the contacting surface and the second contact element of the coupling device independently of the connection area. This permits also using many different binding systems as a coupling device in a simple manner.

However, another embodiment disclosed herein is also of benefit, since this not only creates a contact with the ground when used together with the sport device, but also if the shoe is applied or used without a coupled sport device. This can additionally increase the time of the electrically conductive connection between the user and the ground.

According to another embodiment, this creates the option of using coupling elements already present on the shoe for the electrically conductive connection. Thus, the conductive connection to be produced only needs to be considered within the shoe, in particular in its shell.

In a further embodiment disclosed herein, even during the climb a larger-area contacting surface with the conductive connection between ground and foot of the user is created, and thus an improved discharge of the electrostatic charge from the user to the ground is possible.

A further embodiment disclosed herein is possible for this as well, since this will make discharge of the electrostatic charge from the user to the ground even more secure.

A further embodiment disclosed herein permits creating a simple direct contact to the application element in an arrangement of the ski skin or the electrically conductive skin pile in particular when the board-like sport device has a holder opening or recess. This permits dispensing with the additional equipment or formation of contacting surfaces that must be provided on the sport device otherwise, so that the ski skin or insertion element forms the contacting surface.

Finally, another an embodiment as described herein is possible as well, since this permits using other than board-like sport devices as a sport system for electrical discharge in connection with a shoe. This also makes it possible to achieve a permanent electrically conductive connection between the user's foot and the terrain, i.e. the ground, throughout the sport.

If applicable, the task of the invention can be solved independently of or in combination with a sport device by the characteristics disclosed herein as well. The benefits resulting from the characteristics combination of this claim are that a sport clothing system for a sport system in which a continuous electrical discharge path for discharge of an electrostatic charge from the outer clothing to the user's shoe can be created in this manner. Thus, an electrical contact of the user with the terrain and thus the ground potential is possible throughout the sport. Since at least one of the shoes already has electrical contacting surfaces placed or formed on its outside, secure discharge of the electrostatic charge is ensured at every contact with the ground. This can essentially improve the health and performance of the user, in particular during sports.

However, another embodiment disclosed herein is also of benefit, since this permits creating a secure discharge path for the electrical energy through the contact element placed or formed at the shoe at all times according to the choice and formation of the outer clothing. Thus, proper discharge of the electrostatic charge is possible in the foot area as well.

According to another embodiment, a secure electrically conductive connection is formed from the inside of the shoe to the first contact element or elements placed on the outside of the shoe.

In a further embodiment disclosed herein, this also permits secure discharge at a divided formation of the outer clothing from the upper body to the legs and subsequently to the first contact elements formed at the shoe or shoes.

A further embodiment disclosed herein is also possible, since this permits creating an electrical discharge path via the outer clothing also when using finger-covering clothing such as mittens or gloves.

A further embodiment disclosed herein permits continuous discharge of electrostatic charges even when using a safety helmet by provision or placement of electrically conductive layers in the area of the outer surface and/or in the area of the head holding space.

A further embodiment disclosed herein is of benefit since it also permits discharge of a possible electrostatic charge via the safety helmet, and in the further sequence via the outer clothing to the contact element of the shoe when using protection goggles.

However, another embodiment disclosed herein is also of benefit, since the electrically conductive layer is thus not placed directly on the user's skin. This makes it possible to use skin-compatible materials inside the outer clothing.

A further embodiment disclosed herein is of benefit, since it permits covering the electrically conductive layer with an additional outer layer forming the outer material. Thus, the electrically conductive layer can be protected from external environmental influences better. Apart from this, a diverse layer structure of the outer clothing for many different sports can be provided in this manner.

The task of the invention can, if applicable, be solved independently of or in combination with a sport clothing system, by using the characteristics disclosed herein as well. The benefits achieved from the combination of characteristics of this claim are in also being able to create sport devices that permit grounding at all times and thus discharge of electrostatic charges in the scope of their use in sports. An electrostatic charge produced by friction, in particular air friction, at high speeds, may be discharged at once this way as well. However, an electrostatic charge of the user of the respective sport device can also be prevented by this, and the performance in the sport can thus be improved. The always-possible potential equalization also reduces or entirely prevents a negative influence on the user by the static charge.

A further embodiment disclosed herein permits dispensing with the additional arrangement or embodiment of contacting surfaces, since potential equalization and thus discharge of the electrostatic charge is possible directly through the basic element this way.

A further embodiment disclosed herein is of benefit, since the cladding element that belongs to the basic body can also be grounded and thus potential-equalized in a simple manner. This way, electrostatic charges occurring during sport that would otherwise be transferred to the user can be discharged at once.

A further embodiment disclosed herein is also of benefit, however, since an occurring electrostatic charge of the user can be discharged directly from the outer clothing through the sport device to its contacting surface and thus discharged when the corresponding sport clothing systems with anti-static function is used.

Finally, another embodiment as described herein is possible as well, since this can create an additional discharge option via the pole or poles used while doing sports. This way, a corresponding discharge path can be created via the pole-shaped sport devices in addition to discharge via the shoe.

For better understanding of the invention, it is explained in more detail with the following figures.

Figure 2:
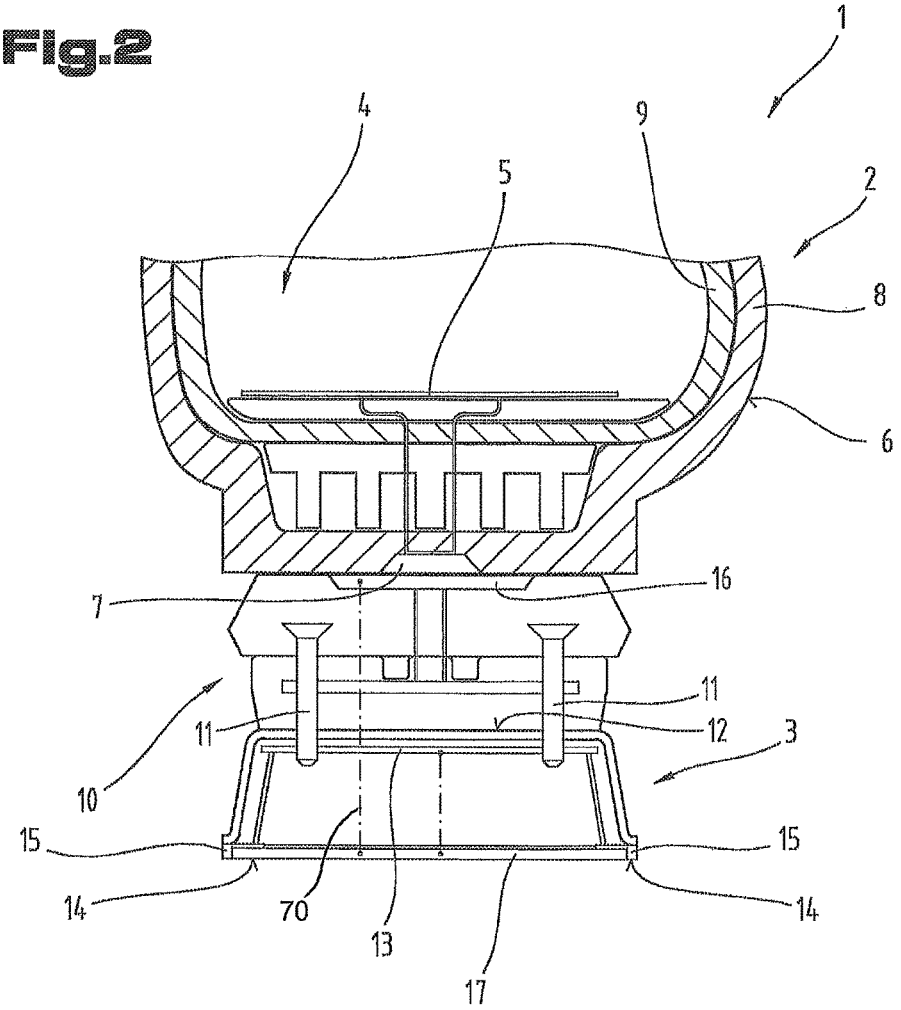
Figure 3:
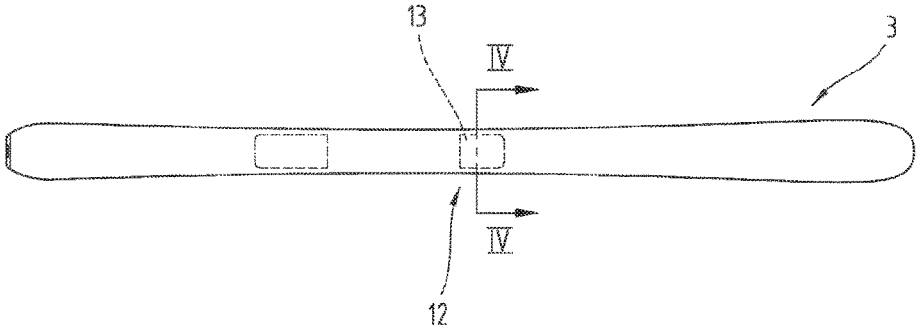
Figure 4:
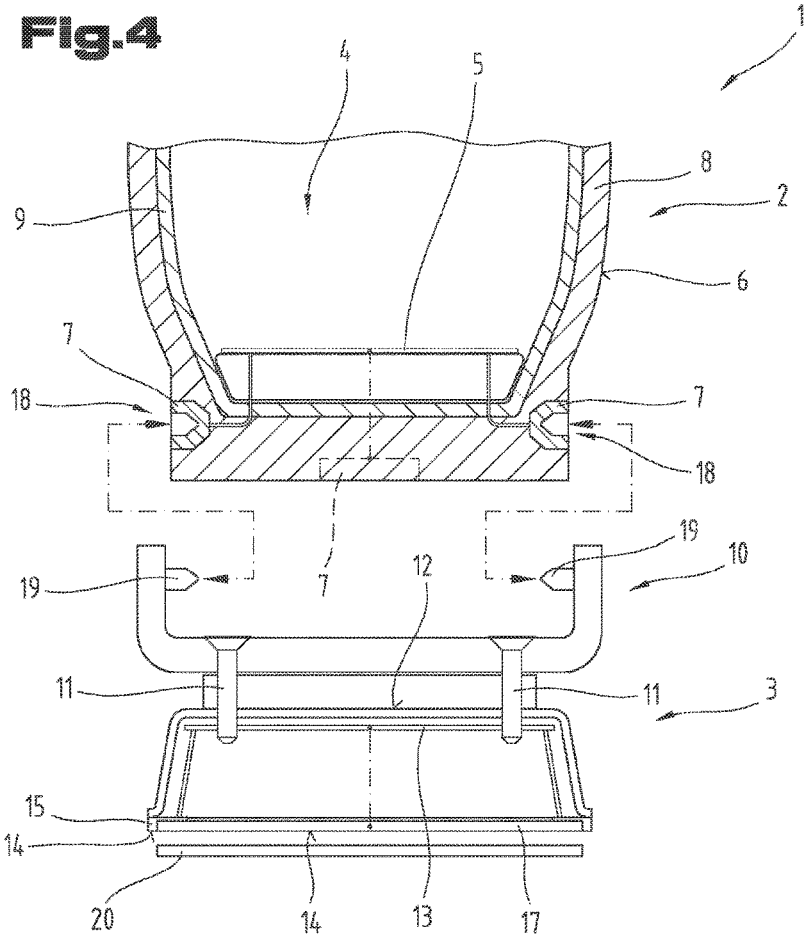
Figure 5:
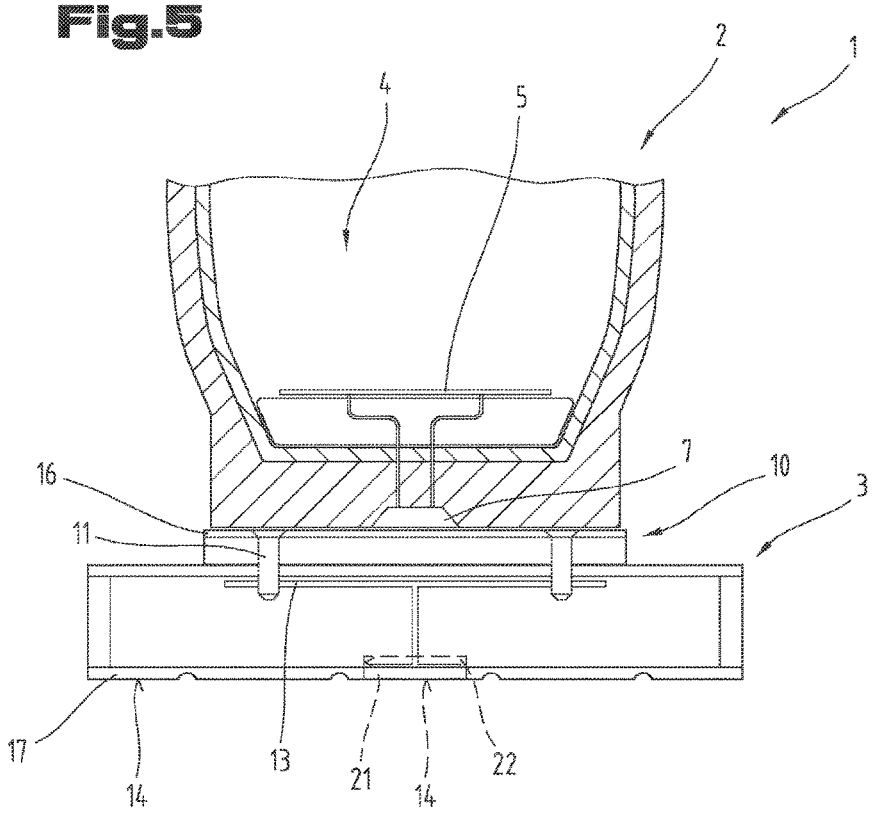
Figure 6:
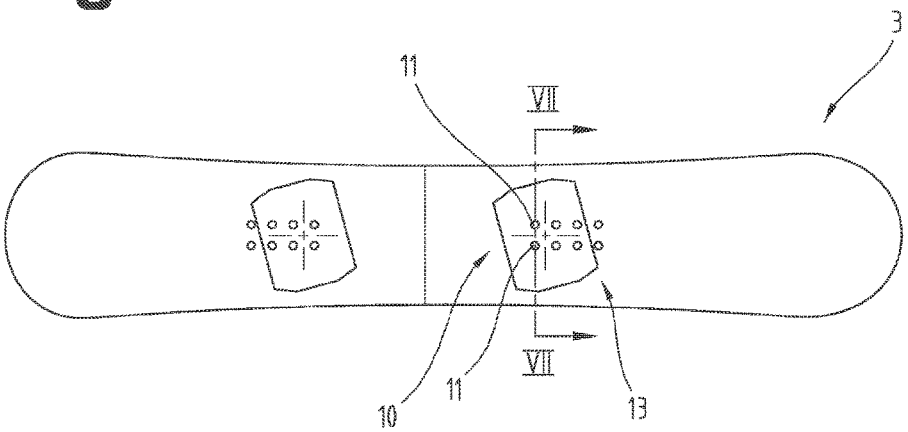
Figure 7:
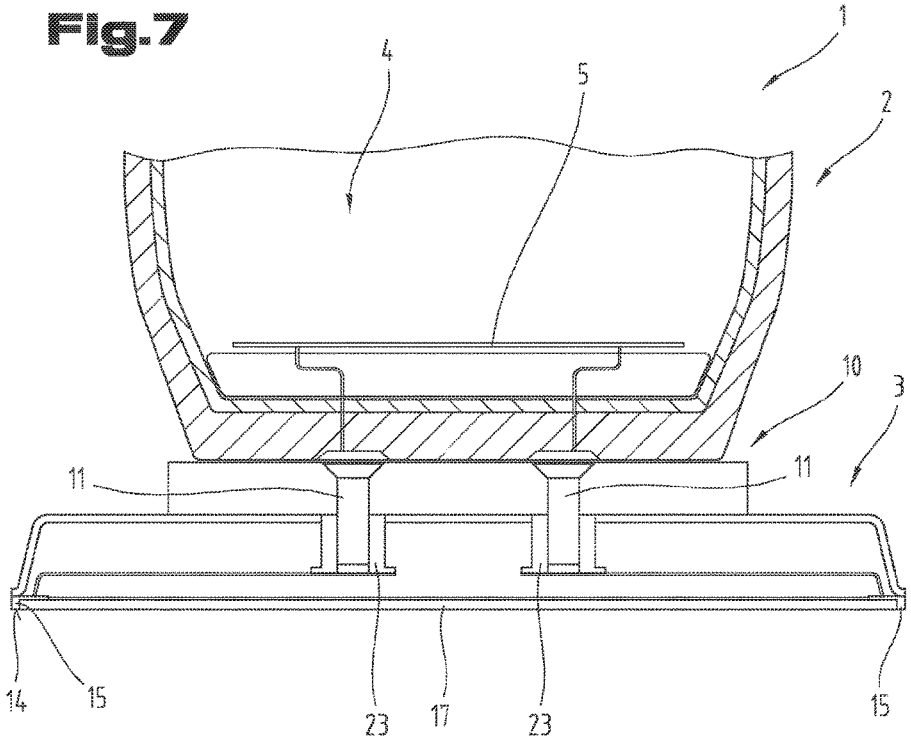
Figure 8:
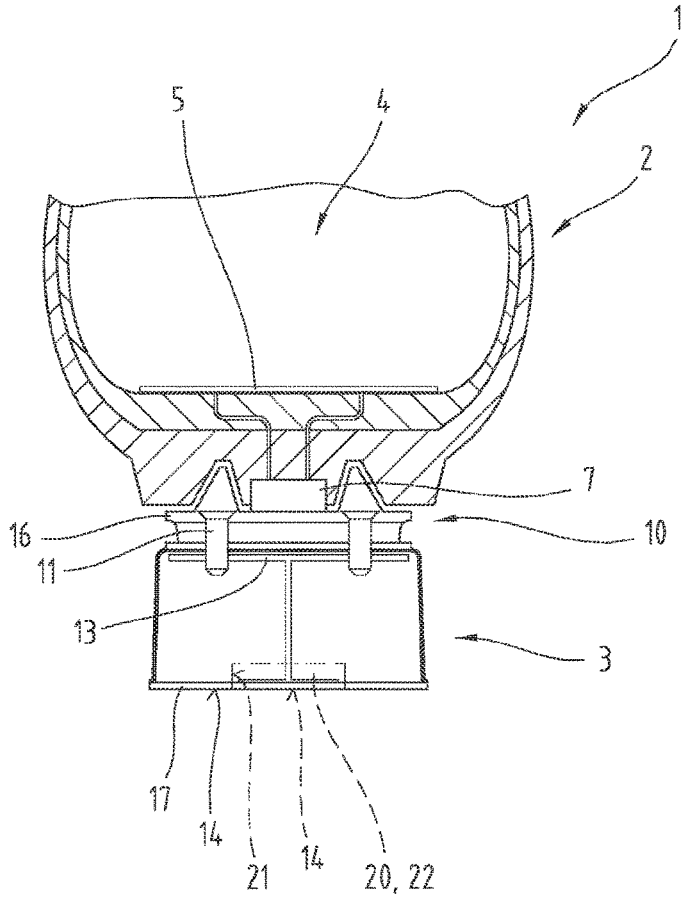
Figure 9:
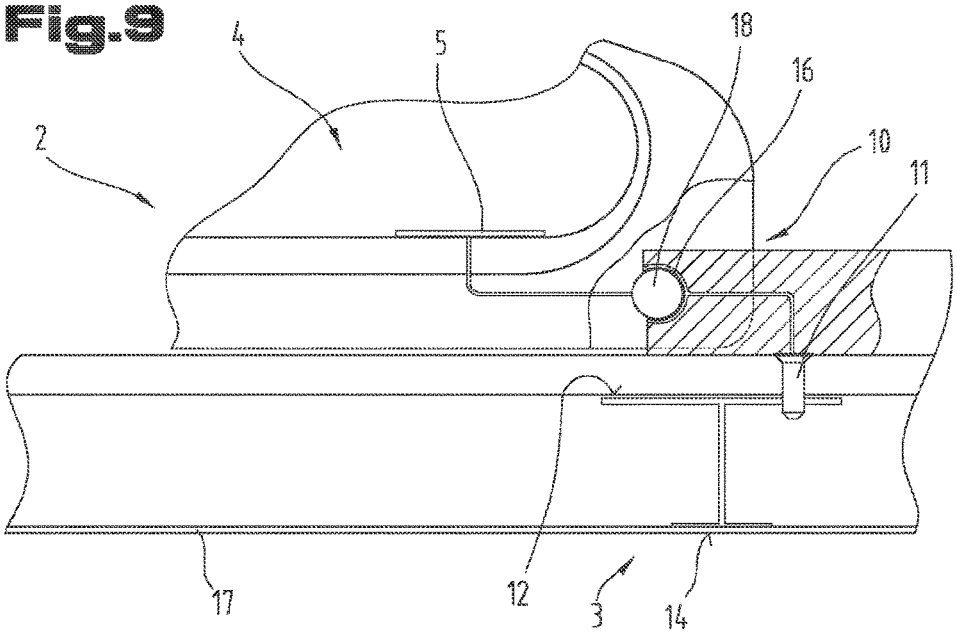
Figure 10:
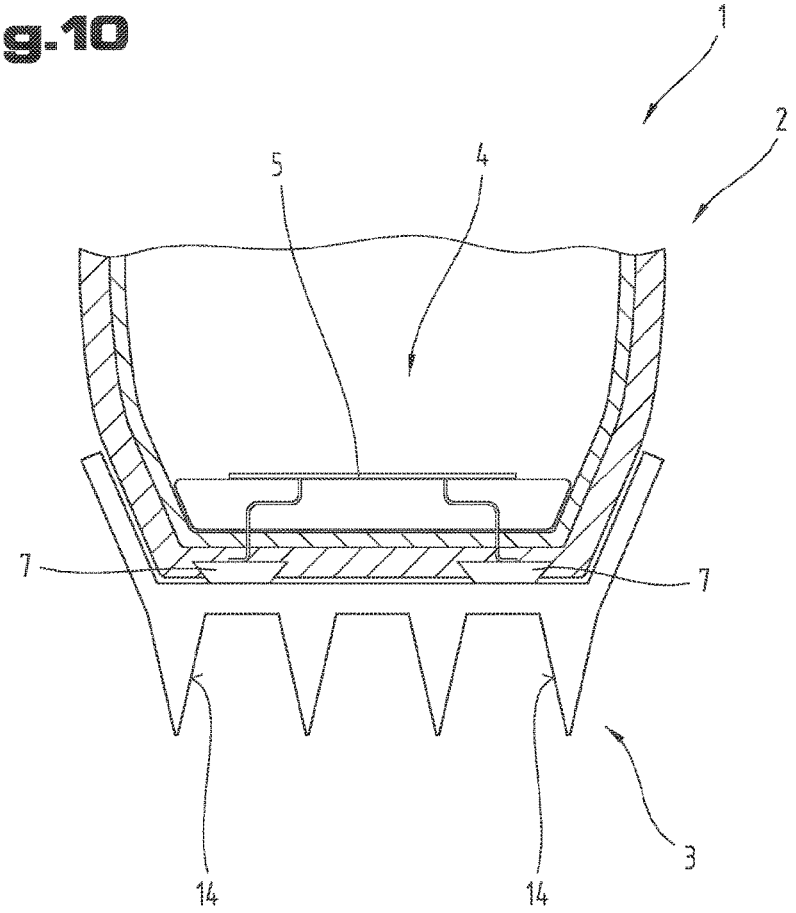
Figure 11:
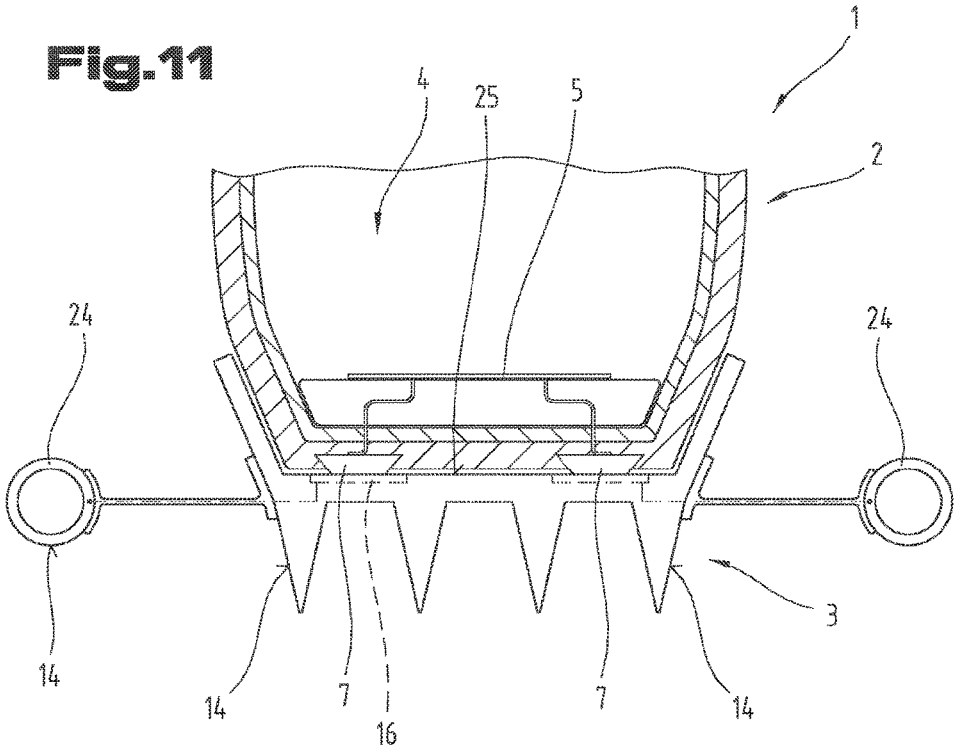
Figure 12:
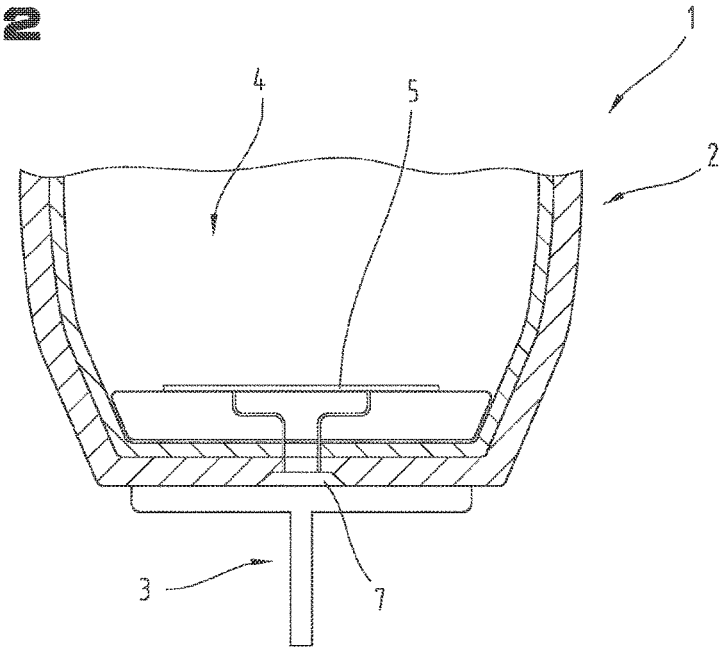
Figure 13:
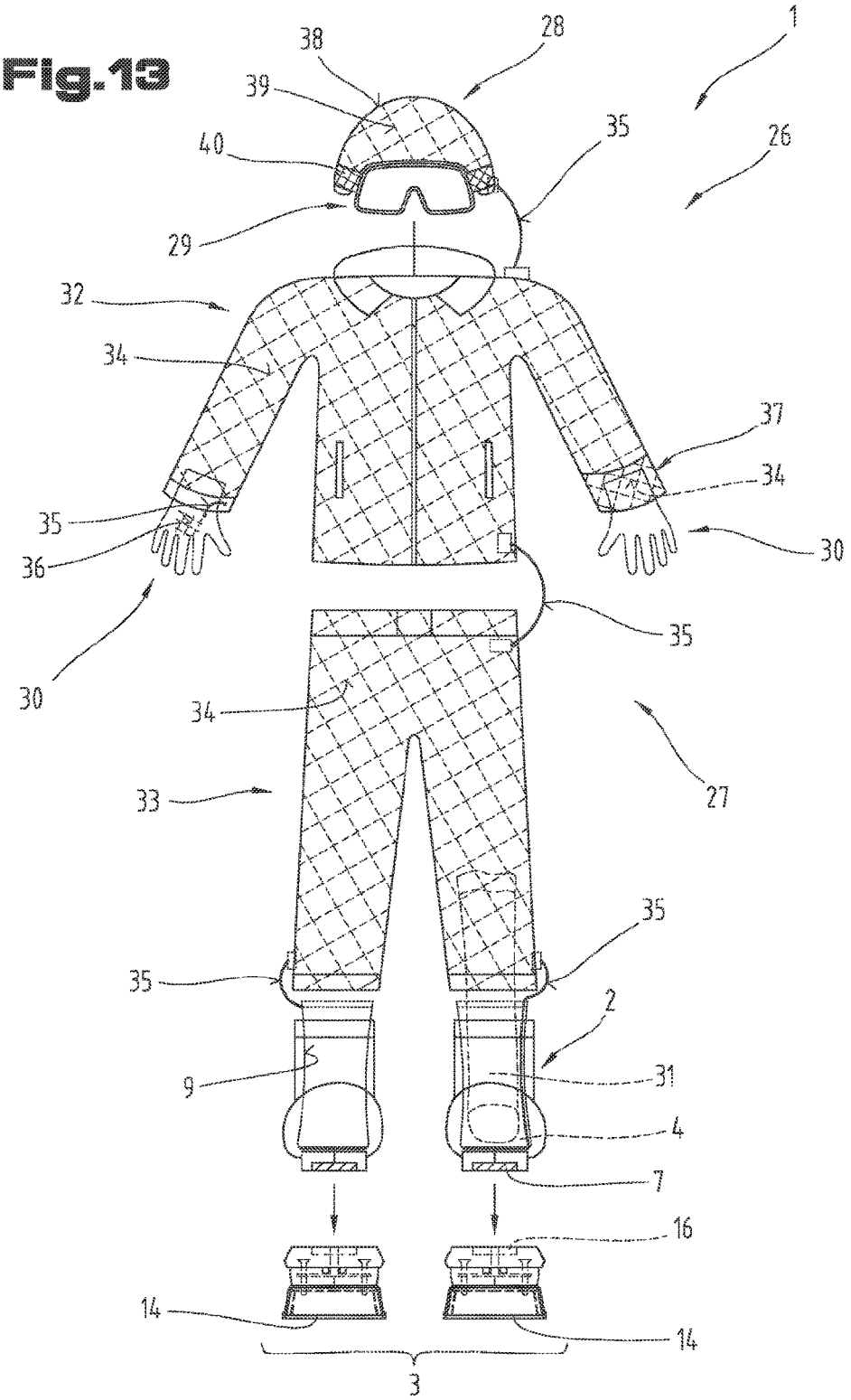
Figure 15:
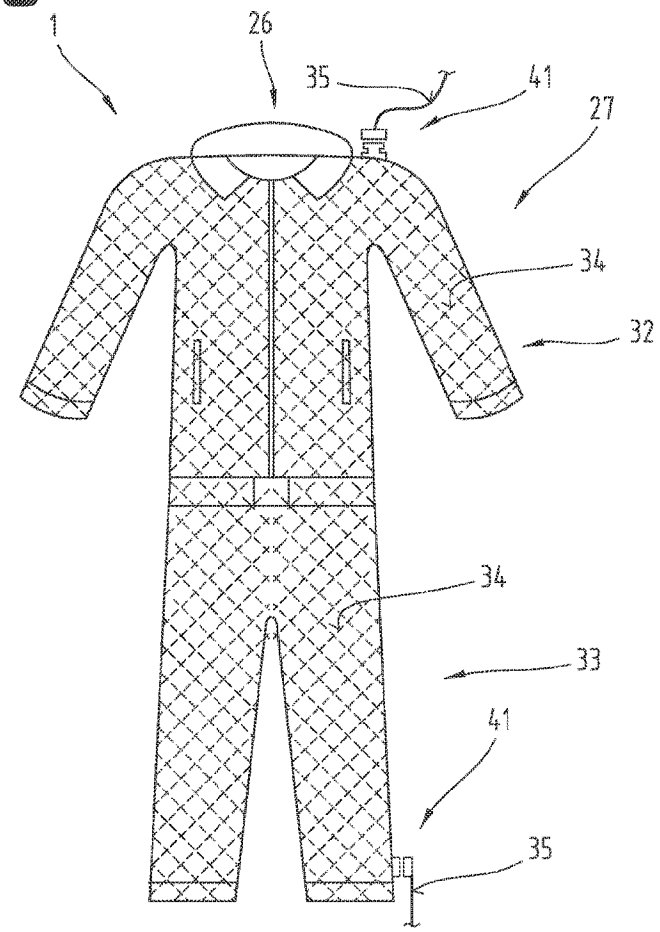
Figure 14:
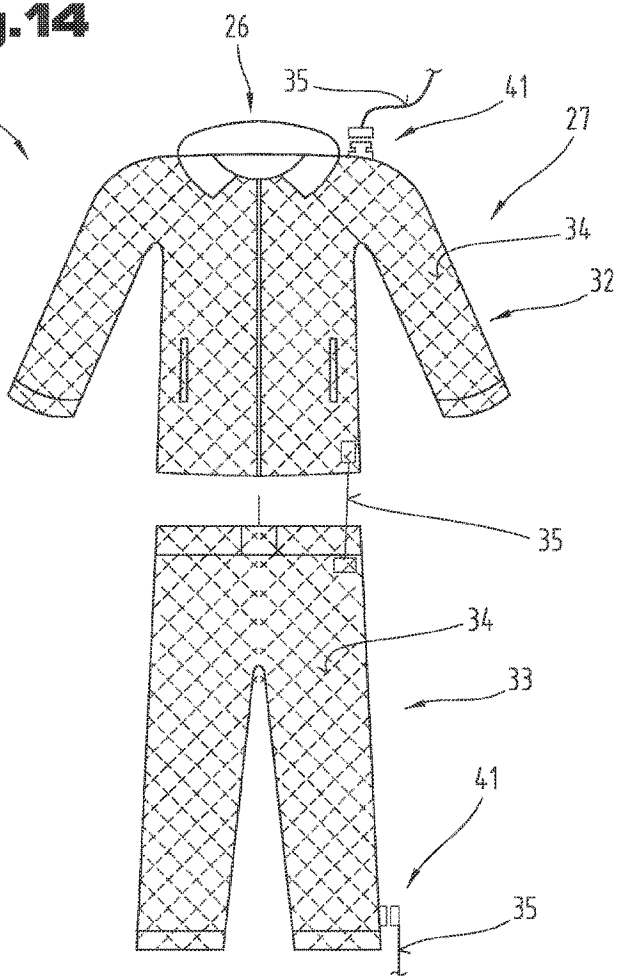
Figure 17:
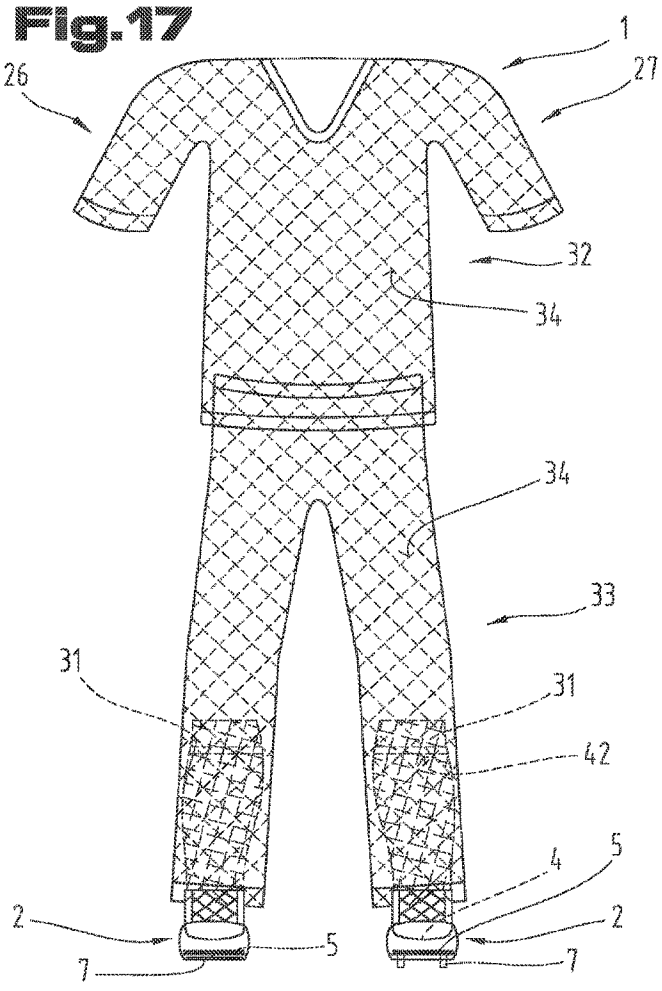
Figure 16:
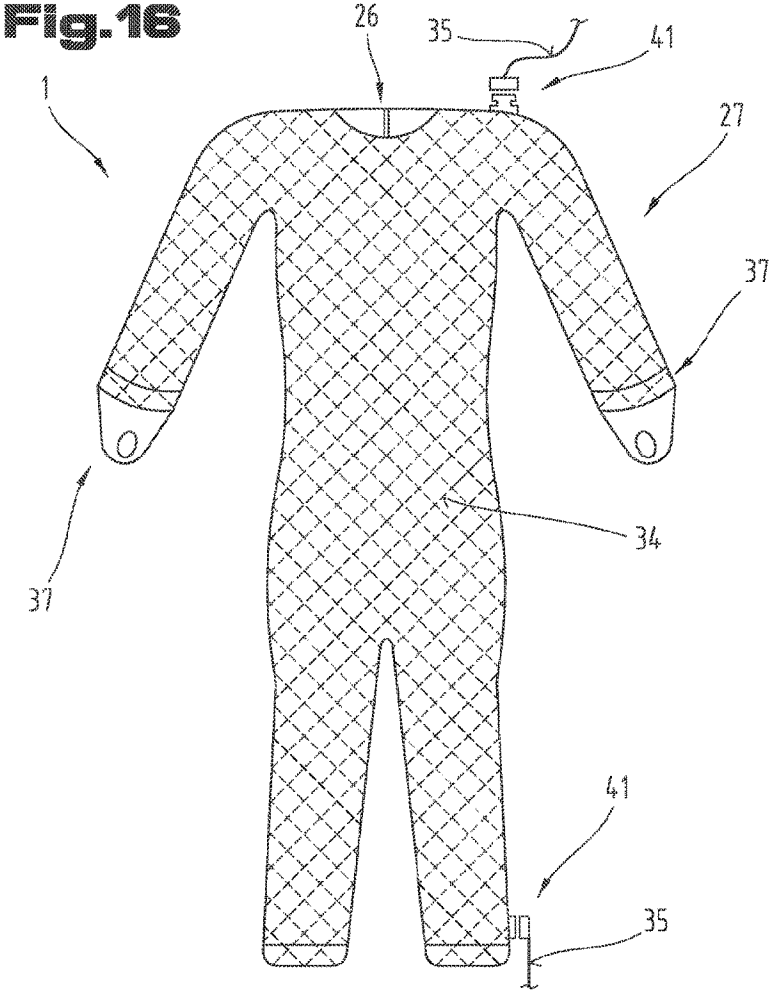
Figure 19:
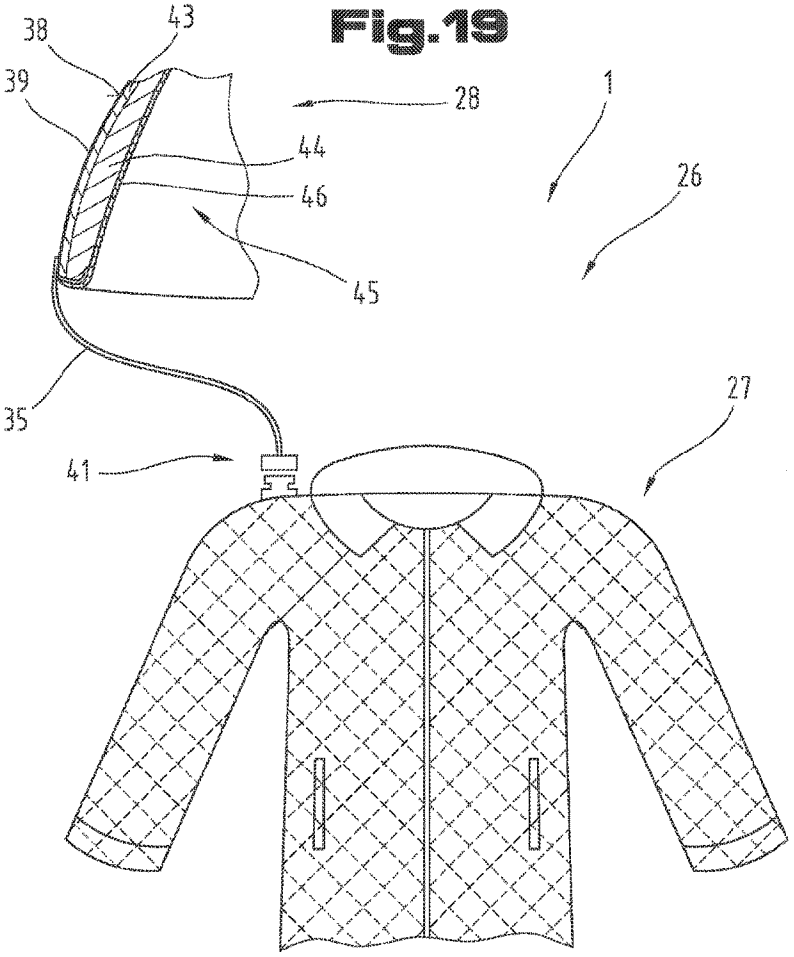
Figure 18:
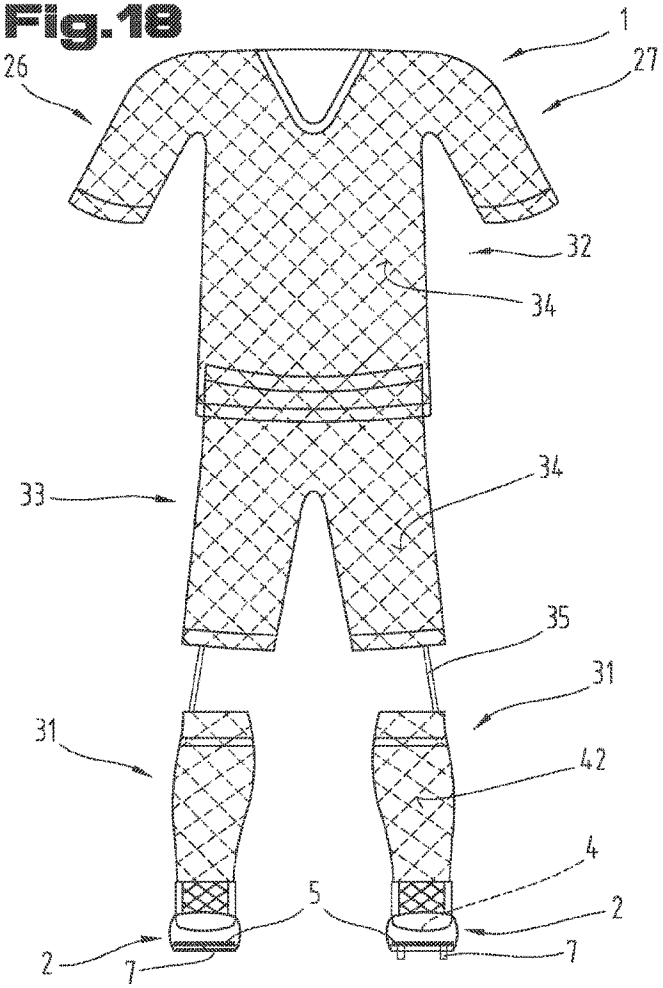
Figure 21:
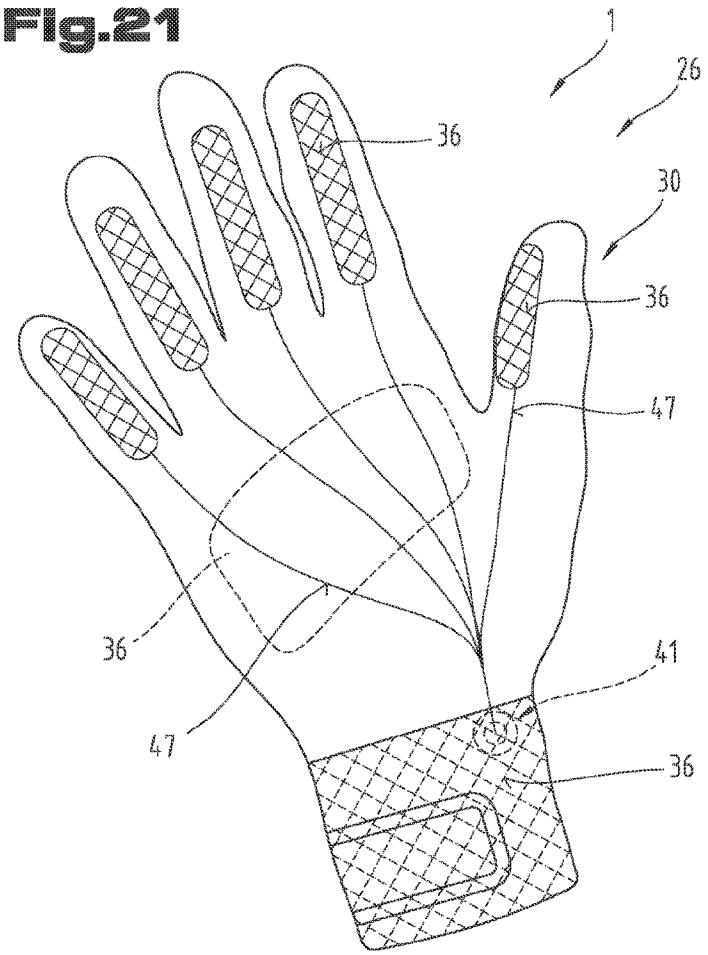
Figure 20:
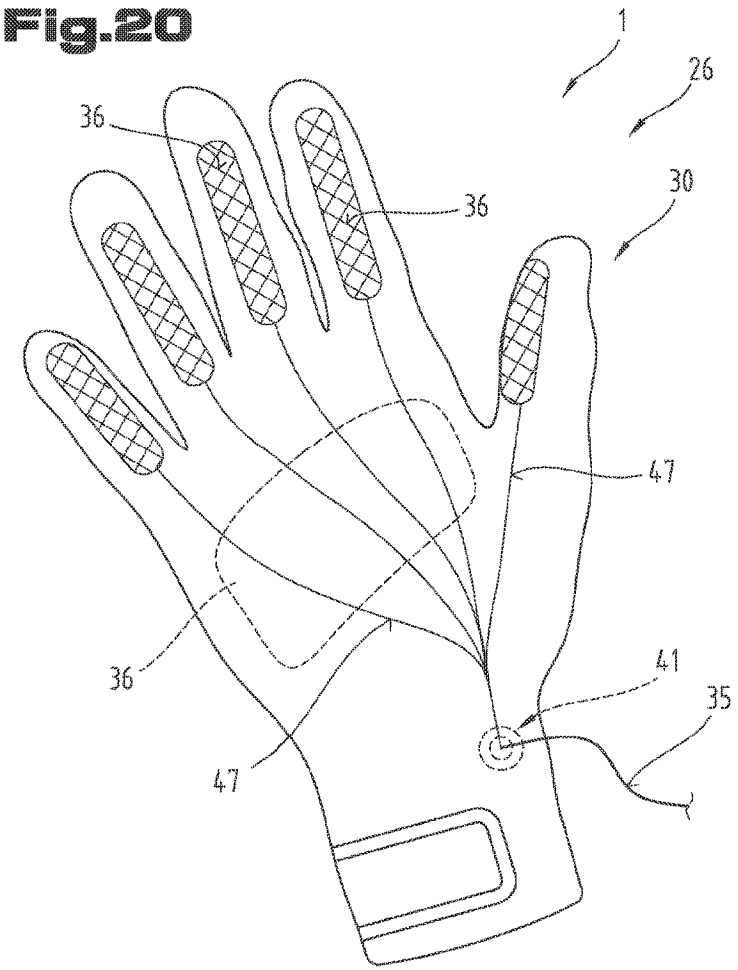
Figure 22:
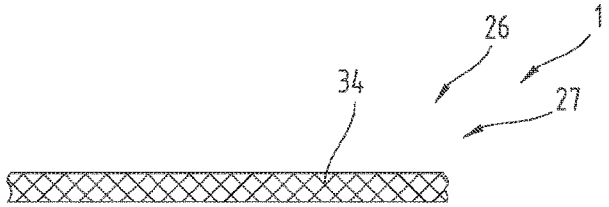
Figure 23:
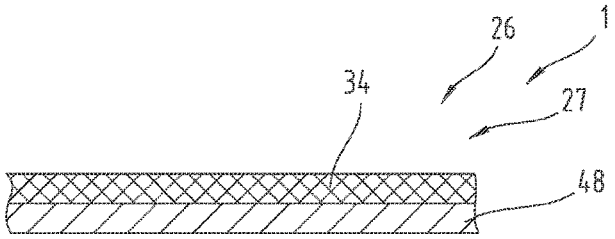
Figure 24:
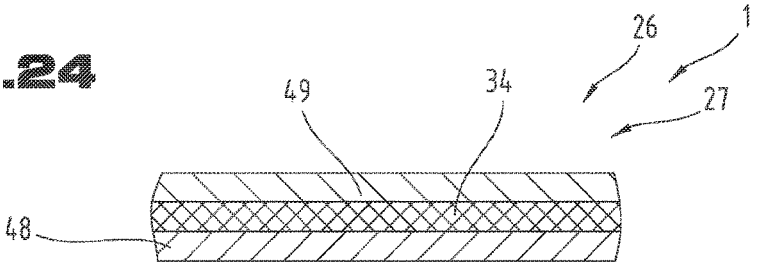
Figure 25:
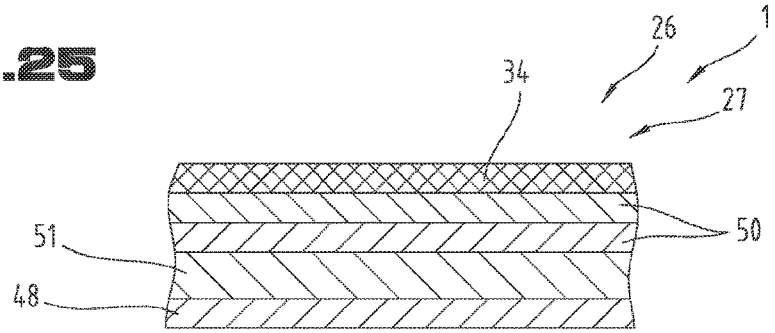
Figure 26:
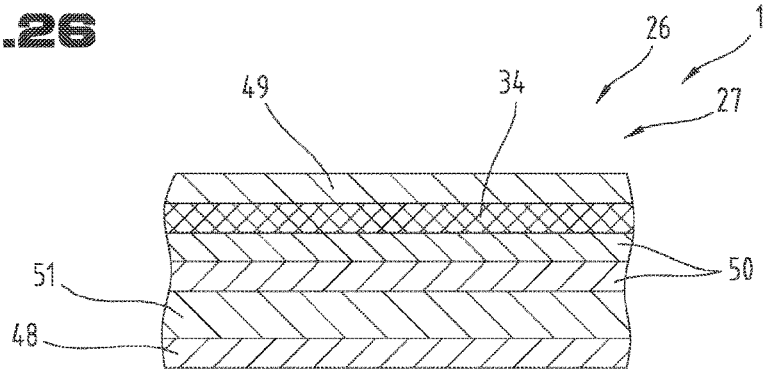
Figure 27:
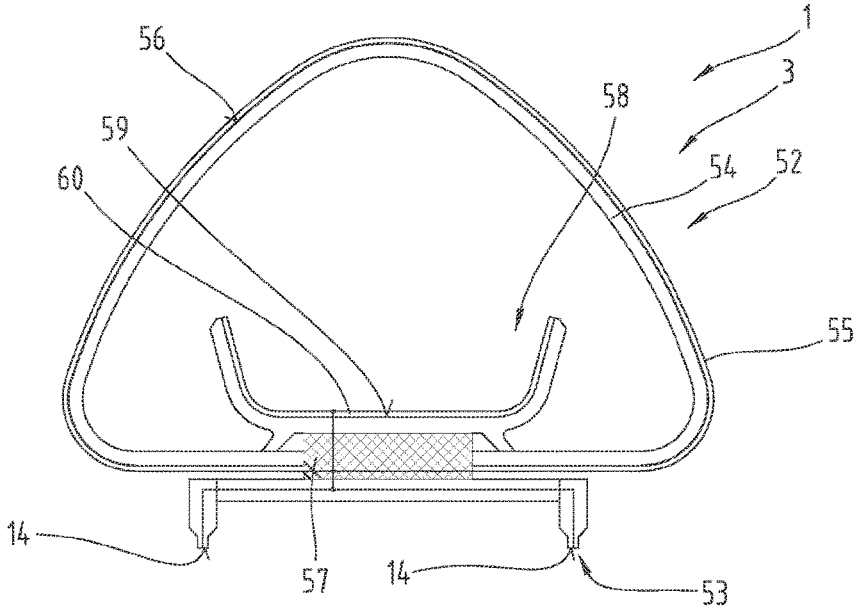
Figure 30:
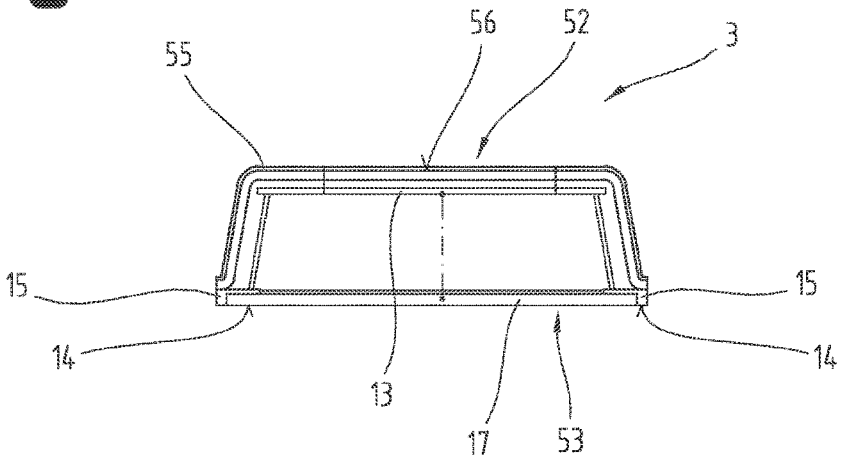
Figure 28:
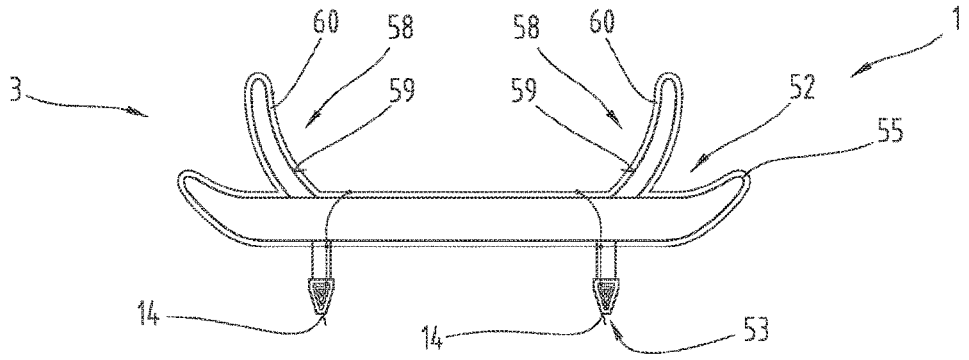
Figure 29:
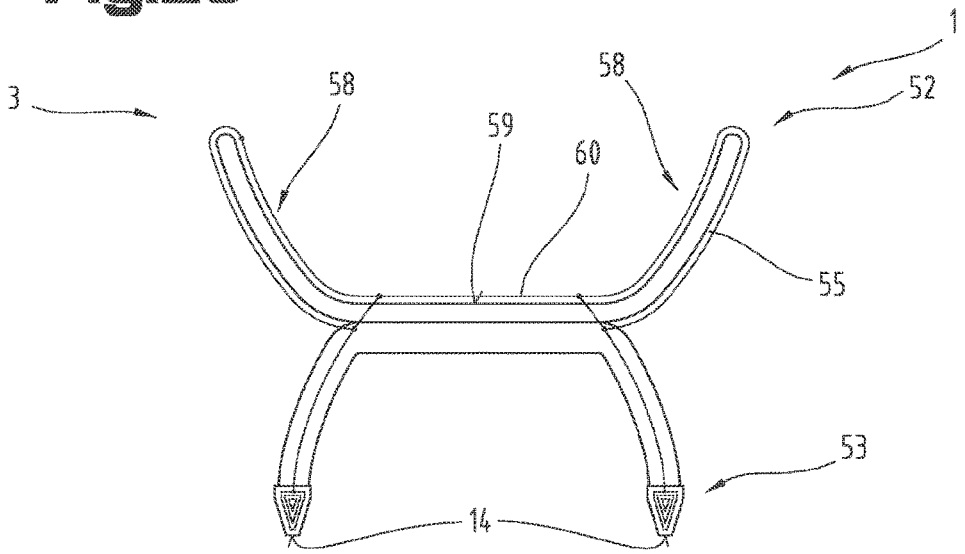
Figure 32:
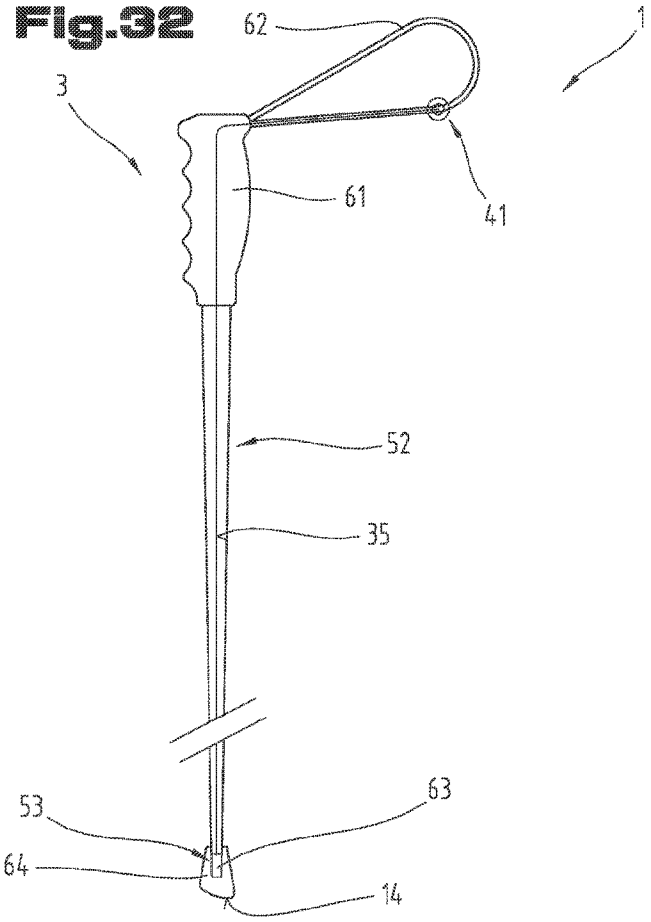
Figure 31:
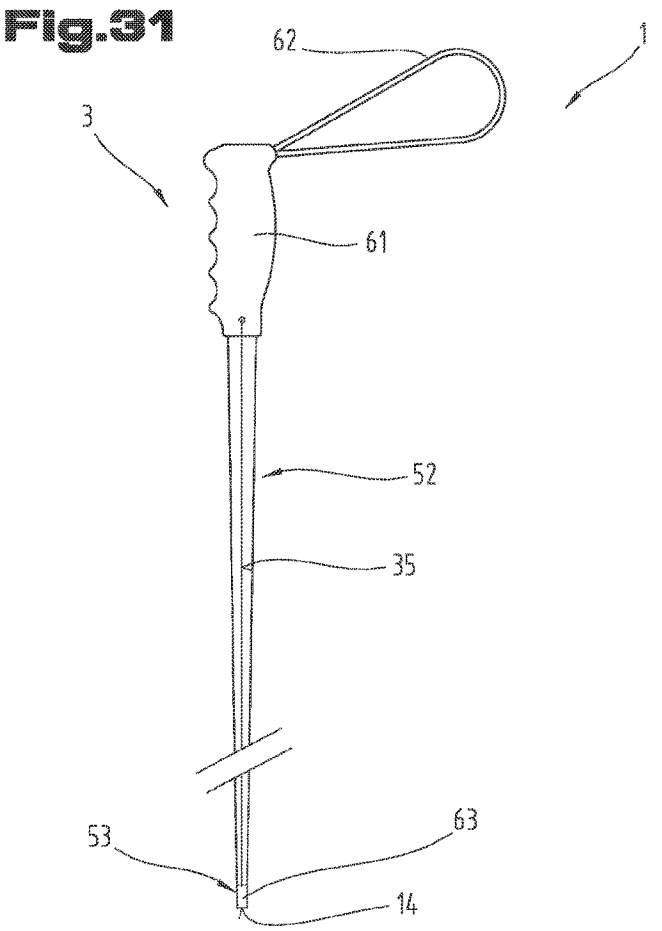
Figure 33:
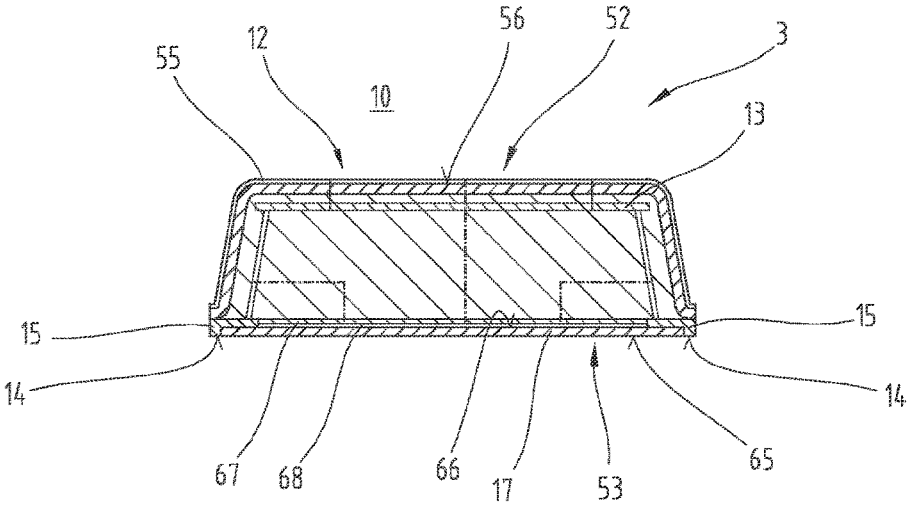
Figure 34:
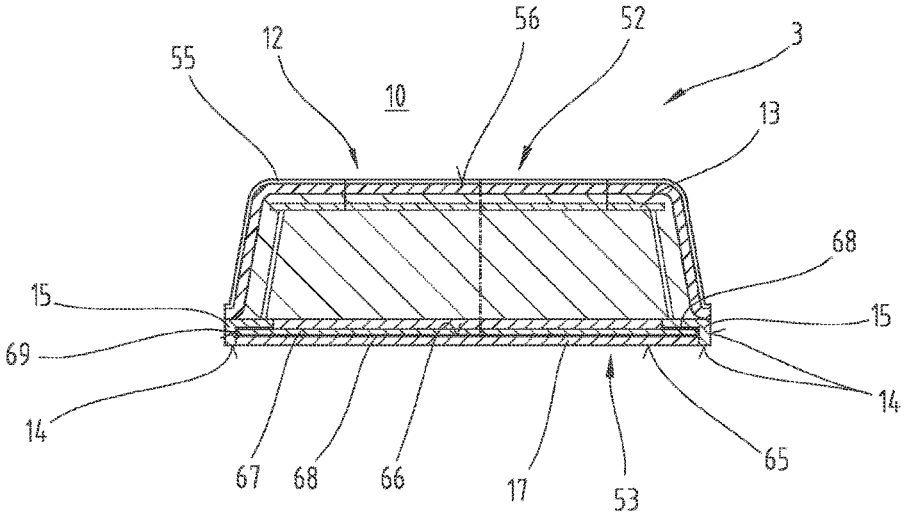

The following is shown in strongly simplified schematic illustrations:

FIG. 1 A first embodiment of a sport system, in which the sport device is formed as an alpine ski, in top view with attached coupling device, but removed shoe;

FIG. 2 The sport system according to FIG. 1 with the sport device and shoe, cut in side view along the lines II-II in FIG. 1;

FIG. 3 A second embodiment of a sport system, in which the sport device is a touring ski, in top view without coupling device and without shoe;

FIG. 4 The sport system according to FIG. 3 with sport device and shoe before coupling to the coupling device, cut in side view along lines IV-IV in FIG. 3;

FIG. 5 A third embodiment of a sport system, in which the sport device is a jump ski, cut in side view;

FIG. 6 A fourth embodiment of a sport system in which the sport device is a snowboard, in top view with the coupling device attached but the shoe removed;

FIG. 7 The sport system according to FIG. 6 with sport device and shoe, in side view, cut along the lines VII-VII in FIG. 6;

FIG. 8 A fifth embodiment of a sport system, in which the sport device is a cross-country ski or back-country ski, cut in side view;

FIG. 9 A sixth embodiment of a partial section of a sport system, in which the sport device is a cross-country ski or back-country ski and a stylized coupling device attacked on it, in view, partially cut;

FIG. 10 A seventh embodiment of a sport system, in which the sport device is a crampon formed, cut in side view;

FIG. 11 An eighth embodiment of a sport system, in which the sport device is a snow shoe, cut in side view;

FIG. 12 A ninth embodiment of a sport system, in which the sport device is a skating skid, cut in side view;

FIG. 13 Another embodiment of a sport system with a sport clothing system and a sport device with continuous antistatic function;

FIG. 14 A first possible embodiment of a sport clothing system with antistatic function;

FIG. 15 A second possible embodiment of a sport clothing system with antistatic function;

FIG. 16 A third possible embodiment of a sport clothing system with antistatic function;

FIG. 17 A fourth possible embodiment of a sport clothing system with antistatic function;

FIG. 18 A fifth possible embodiment of a sport clothing system with antistatic function;

FIG. 19 A connection option of a safety helmet to the outer clothing of a sport clothing system;

FIG. 20 A possible embodiment of a finger clothing with antistatic function;

FIG. 21 Another embodiment of a finger clothing with antistatic function;

FIG. 22 A first layer structure of the outer clothing with antistatic function, cut;

FIG. 23 A second layer structure of the outer clothing with antistatic function, cut;

FIG. 24 A third layer structure of the outer clothing with antistatic function, cut;

FIG. 25 A fourth layer structure of the outer clothing with antistatic function, cut;

FIG. 26 A fifth layer structure of the outer clothing with antistatic function, cut;

FIG. 27 A possible embodiment of a sport device with antistatic function, in cross-section;

FIG. 28 Another embodiment of a sport device with antistatic function;

FIG. 29 Another possible embodiment of a sport device with antistatic function;

FIG. 30 Another possible embodiment of a sport device with antistatic function, in cross-section;

FIG. 31 Another embodiment of a sport device with antistatic function;

FIG. 32 Another embodiment of a sport device with antistatic function;

FIG. 33 Another possible embodiment of an antistatically formed sport device, in cross-section;

FIG. 34 Another possible embodiment of an antistatically formed sport device, in cross-section.

Initially, it should be noted that the differently described embodiments have same parts applied with the same reference numerals or the same component names, with the disclosures contained in the complete description being transferrable accordingly to same parts with the same reference numerals or same component names. Apart from this, the position indications chosen in the description, such as top, bottom, side, etc., refer to the directly described and illustrated figure and these position indications must be transferred to the new position accordingly if the position is changed. The term "in particular" is used below to mean that it may be a possible more specific embodiment or more detailed specification of an object or a possible process step, but not necessarily needs to be a mandatory preferred embodiment of the same or a procedure. Antistatic function means that the sport device is formed antistatically on its own or in combination with the shoe and further clothing or the shoe in combination with at least one piece of clothing and thus permits contacting the earth.

In FIGS. 1 to 12, different examples of sport systems 1 are shown and described. It should be noted that there are further application areas beyond this in which a user wears shoes 2 and the shoe or shoes 2 are connected to a sport device 3, in particular coupled, or directly applied with it. If the sport device 3 comprises several components, it can also be called a sport device system. This is in particular the case when parts to achieve an antistatic function for the user are present or used. The following embodiments that are only exemplary for a plurality of possibilities can be combined with the sport clothing system 26 described in FIGS. 13 to 26 and/or the different sport devices 3 according to FIGS. 1 to 12 and FIGS. 27 to 33.

Preferably, the sport systems 1 are winter sport systems, ball sport systems and systems for other athletic leisure time activities, such as hiking, mountaineering, climbing, X-Country, Nordic Walking and many other sports, with all sport systems 1 having an antistatic function. This means that the user of such a system will be in electrically conductive contact with the ground even when using the sport device 3 and the sport system 1 is thus antistatically formed.

In the first embodiments of the sport system 1, different combination options of the shoe 2 with the sport device 3 are described, with a permanent electrical discharge path from the inside of the shoe 2 via the sport device 3 to the ground.

The user of the shoe 2, in particular in case of a shoe intended for winter sports, usually wears a sock or stocking, and thus will not be in direct skin contact with the electrical discharge element 5 placed on the inside of the shoe 4. Therefore, it must be observed in this case that the sock or stocking permits an electrically conductive connection between the user's skin and the at least one electrical discharge element 5. For this, many different known electrically conductive systems can be used for the footwear worn directly on the skin.

The electrical discharge element 5 can be formed, e.g., by electrical conductors in the shoe insole, a shoe insole formed of an electrically conductive material or electrical conductors placed directly at the inside of the shoe. However, it would also be possible if the shoe 2 comprises a shoe shell and an inner shoe inside it that the inner shoe comprises an electrically conductive layer at least in sections at its inner surface turned towards the inside of the shoe 4 and/or the inner shoe.

As is already known in shoes, in particular also in sport shoes, the electrical discharge element 5 placed inside the shoe 4 is connected electrically conductively to at least one first contact element 7 placed or formed at an outside 6 or an outer surface of the shoe 2. The outside 6 or outer surface of the shoe 2 therefore is the surface that surrounds the shoe 2 on the side facing away from the inside of the shoe 4. The first contact element or elements 7 may be placed or formed at the outside 6 or outer surface and/or reach into it. Thus, the first contact element 7 can be connected electrically conductively to a foot of the user to be held in the shoe 2. This is also the case if the shoe 2 comprises a solid outer shell 8 and an additional inner shoe 9 held inside it.

All parts or elements described below that serve electrically conductive connection between the inside of the shoe 4 and the sport device 3, in particular its contacting surface 14, may be described as an electrical discharge device in their entirety.

The sport device 3 can be formed in many different manners. For example, if it is formed board-like, it may be chosen, e.g., as a winter sport device from the group of alpine ski, cross-country ski, back-country ski, jump ski, touring ski, snowboard.

Independently of this, the sport device 3 may be chosen from the group of snow shoe, crampon, skating skid.

Thus, FIGS. 1 and 2 show a first possible embodiment of the sport system 1, which is formed in the present embodiment by a ski shoe and an alpine ski as sport device 3.

A coupling device 10 is placed on the sport device 3 formed as an alpine ski here to hold the shoe 2 in a coupled position at the board-like sport device 3. The coupling device 10 is also called the ski binding in the present embodiment, which has a front and a toe element and a heel element as well as possibly plate-like interim elements. The coupling device 10 can further be connected to the sport device 3 by at least one connection element 11. The two connection elements 11 shown here in FIG. 2 are suggested schematically as screws and protrude beyond the coupling device 10 towards the sport device 3 until they protrude into the board-like sport device 3 in the known manner to act as a holder.

The coupling device 10 is arranged at the board-like sport device 3 in at least one attachment area 12 which is provided at least in the area of the toe element and/or the heel element at the sport device 3 but can also continue throughout the length of the coupling device 10.

Furthermore, it is intended that an application element 13 formed of an electrically conductive material is provided or placed at least in the attachment area 12 of the coupling device 10 at the board-like sport device 3 at and/or within the board-like sport device 3. In this embodiment, the application element 13 is placed, e.g., in the area of the upper belt of the ski and can additionally serve to increase the tearing resistance of the connection elements 11 at attachment of the coupling device 10. To be able to form the connection element or elements 11 as electrical conductors, they must be formed of an electrically conductive material.

The board-like sport device 3 here has at least one contacting surface 14 at the bottom, which can be turned towards a terrain. In board-like sport devices 3, the contacting surface 14 may be formed, e.g., by at least one side edge 15 formed of an electrically conductive material. This is usually formed of a metal material.

As further better evident from FIG. 2, the discharge element 5 placed inside the shoe 4 is electrically conductively connected with the first contact element 7 placed at the shoe 2. At the coupling device 10, a second contact element 16 can be placed or provided in the area of the first contact element 7 opposite or directly adjacent to it. The second contact element 16 can be formed, e.g. by a part of a support area for the shoe 2 at the coupling device 10. The at least second contact element 16 is in contact with the first contact element 7 of the shoe 2 in a position coupled with the shoe 2 and thus connected electrically conductively.

To create an electrically conductive connection between the second contact element 16 of the coupling device 10 and the contacting surface 14, an electrically conductive connection must be created here as well. The second contact element 16 of the coupling device 10 is electrically conductively connected to the application element 13 here. This can be implemented, e.g., by at least individual components of the coupling device 10 being formed directly of an electrically conductive material. The second contact element 16 is further electrically conductively connected to these electrically conductively formed parts. The electrically conductively formed components of the coupling device 10 reach at least to the connection element or elements 11, which are electrically conductively connected to the application element 13 in the present embodiment. By connecting the application element 13 in turn electrically conductively to the contacting surface 14 as described before, a continuous electrically conductive connection between the discharge element 5 placed inside the shoe and the contacting surface 14, which is formed as a side edge 15 here, is created.

Independently of this or in addition to this, board-like sport devices 3 may have a contacting surface 14 also formed by at least one partial section of a running surface layer 17 formed of an electrically conductive material. Since running surface layers 17 are usually made of a plastic material, this material can have electrically conductive properties on its own and/or the material may be interspersed with electrically conductive particles. To create an electrically conductive connection between the contacting surface 14 formed as a running surface layer 17 and the application element 13, a conductive connection is illustrated schematically simplified in dashed lines. The electrical connection between the contacting surfaces 14 formed as side edges 15 and the application element 13 is suggested as a schematic conductive connection on both sides of the side faces of the ski. It should be mentioned that the electrically conductive connection could be formed by cables, special glues, insertion parts or similar, which connect the corresponding parts electrically conductively.

Independently of this, it would also be possible to dispense with the arrangement or provision of the application element 13 in the attachment area 12 and to electrically conductively connect one or several of the contacting surfaces 14 of the board-like sport device 3 directly to the second contact element 16 of the coupling device 10 using a cable 70 illustrated simplified with broken-dotted lines. An additional contact of the contacting surface 14 formed as a side edge would also be possible. Furthermore, independently of this it would also be possible to electrically conductively connect the contacting surface 14 formed as a side edge directly to the second contact element 16 of the coupling device 10. This could also be done with a cable.

In this embodiment, the first contact element 7 at the shoe 2 is placed or formed in the sole section. Preferably, this is done in the front sole section, usually below the ball area.

FIGS. 3 and 4 illustrate another and possibly independent second embodiment of the sport system 1, with the same reference numerals or component names as in the above FIGS. 1 and 2 again being used for the same parts. To avoid unnecessary repetitions, the detailed description in the preceding FIGS. 1 and 2 is noted or referred to.

In the embodiment displayed and described here, the sport device 3 is formed as a touring ski with a coupling device 10 designed as a touring binding. The shoe 2 is formed, e.g., as a touring ski shoe, which may have its own attachments or insertion parts in its shell 8 that may serve direct coupling to the coupling device 10 depending on binding system.

This sport system 1 is generally built very similarly to the one that has already been described in detail above in FIGS. 1 and 2. The coupling device 10 is attached to the sport device 3 by the connection elements 11 in the intended attachment area 12. In the board-like sport device 3, the application element 13 is placed or provided in the area of the upper belt again. The contacting surface or contacting surfaces 14 can be formed by the side edge 15 and/or the running surface layer 17. The electrically conductive connection between the connection elements 11, in applications with an interim application element 13, may take place accordingly towards the contacting surfaces 14 as already explained in detail above.

In contrast to the design described above and the arrangement of the first contact element 7 at the shoe 2, it is intended here that the first contact element 7 is not formed in the sole area of the shell 8 but by at least one coupling element 18 placed or formed at the shoe 2. These coupling elements 18 may be formed, e.g. by a metal insert each, which are integrated or inserted into the shell 8 during its production and thus held firm to it. The coupling elements 18 each have a cylindrical holder opening into which the coupling pins 19 of the coupling device 10 reach when coupled with the shoe 2.

In the shoe 2, a first electrically conductive connection is formed between the discharge element 5 and the coupling elements 18 in this manner.

Since the coupling pin or pins 19 and at least individual further components of the coupling device 10 are formed of electrically conductive materials, a conductive connection can in turn be created between the discharge element 5 placed inside the shoe 4 and the contacting surface 14. In the coupled position of the shoe 2 at the coupling device 10, the conductive connection to the contacting surfaces 14 is thus created via parts of the coupling device 10, the connection elements 11 and possibly using an interim application element 13.

Further, it would also be possible, however, to place or provide at least one additional first contact element 7 in the sole area of the shoe 2, to achieve grounding of the user even if he is not currently using the sport device 3.

Furthermore, it is illustrated in a simplified schematic here that a ski skin 20 that can be connected to the sport device 3 can be placed in the area of the running surface layer 17, which, however, is displayed still separated from the running surface layer 17 and which is removably attached to it in the known manner. The ski skin 20 applied to the running surface layer 17 serves to increase hold of the sport device 3 in the terrain formed by snow when using touring skis in climbing mode.

Thus, it is possible here that the sport device 3 formed as touring ski forms at least one contacting surface 14 with its side edges 15 and/or running surface layer 17. To achieve an additional contact with the terrain via the ski skin 20, which covers the running surface layer 17 at least partially, the ski skin 20 can be formed electrically conductively and/or be applied with an electrically conductive skin pile at least in partial sections. Thus, a large-area contact surface can also be created during climbing movements for electrically conductive connection between the ground and the user's foot. To create an even better electrically conductive connection, the electrically conductive partial section of the ski skin 20 and/or the electrically conductive skin pile can be electrically conductively connected to at least one of the contacting surfaces 14.

Independently of this, it would also be possible that the electrically conductive partial section of the ski skin 20 and/or the electrically conductive skin pile is electrically conductively connected directly to the application element 13.

FIG. 5 shows another and possibly independent third embodiment of the sport system 1, with the same reference numerals or component names being used for the same parts as in the previous FIGS. 1 to 4 again. To avoid unnecessary repetitions, the detailed description in the preceding FIGS. 1 to 4 is noted or referred to.

In the embodiment shown here, the sport device 3 of the sport system 1 is formed by a jump ski. The shoe 2, which can be connected to the sport device 3 again for its use via a coupling device 10 that is not illustrated in more detail, is formed accordingly.

In the inside of the shoe 4 in turn, the discharge element 5, which is electrically conductively connected to the first contact element 7, here placed in the sole area of the shoe 2, for contact with the user. This is suggested simplified by lines. In the area of the coupling device 10 and directly opposite the first contact element 7, the second contact element 16, which is in direct electrically conductive contact with the connection elements 11 in the present embodiment, is provided.

The application element 13, to which the second contact element 16 is electrically conductively connected via the connection elements 11 by attachment of the coupling device 10, can be placed within the sport device 3.

In the sport device 3 formed here as a jump ski, the running surface layer 17 is provided as a contacting surface 14, wherein the contacting surface 14 is electrically conductively connected to the application element 13.

It would, however, also be possible to provide a holder opening 21 in the area of the running surface layer 17, which serves to hold an insert 22. Thus, the insert 22 suggested here with dashed lines can form the contacting surface 14 as an electrically conductive element and can in turn be electrically conductively connected to the application element 13 and/or the connection elements 11. The insert 22 or insertion element can also be formed by the ski skin 20 or applied with it. These different embodiments of the ski skin 20, the insert 22 and their electrically conductive properties may also be used in other board-like sport devices or be applied there.

Furthermore, a dedicated coupling element 18 that is not illustrated in any more detail here, which can be connected to a part of the coupling device 10 in the coupled position may be placed or provided at the shoe 2. The coupling element 18 could be placed, e.g., in the toe or ball area at the shoe 2 and be formed directly from an electrically conductive material.

FIGS. 6 and 7 show another and possibly independent fourth embodiment of the sport system 1, with the same reference numerals or component names being used for same parts as in the previous FIGS. 1 to 5 again. To avoid unnecessary repetitions, the detailed description in the preceding FIGS. 1 to 5 is noted or referred to.

This possible further embodiment of the sport system 1 comprises a snowboard as a sport device 3, which can be formed in a single-part or divided shape. Since this board-like sport device 3 usually also has side edges 15, these in turn can form the contacting surfaces 14. In such sport devices 3, it is common that at least one attachment element 23 is placed or formed in the board-like sport device 3's attachment area 12. Since such attachment elements 23 are usually sleeve-shaped parts with an inner thread and these may be formed of an electrically conductive material, a direct electrically conductive connection to the contacting surface 14, in particular the side edge 15 and/or the running surface layer 17, is possible.

The connection element or elements 11 serve connection of the coupling device 10 to the sport device 3 and are connected to the respective attachment element 23, in particular screwed into it. Thus, the connection element 11 may also be contacted by the first contact element 7 of the shoe 2 directly in a position coupled with the shoe 2 in this embodiment. This way, the second contact element 16 of the coupling device 10 may be dispensed with.

In addition to or independently from this, however, it would also be possible to provide the second contact element 16 described above at the coupling device 10 to achieve a better contact with the first contact element 7 of the shoe 2.

FIG. 8 shows another and possibly independent fifth embodiment of the sport system 1, again with the same reference numerals or component names being used for same parts as in the previous FIGS. 1 to 7. To avoid unnecessary repetitions, the detailed description in the preceding FIGS. 1 to 7 is noted or referred to.

The further possible embodiment of the sport system 1 comprises cross-country skis or back-country skis as a sport device 3 and a cross-country shoe or sport shoe formed for this as a shoe 2. The shoe 2 can be connected to the sport device 3 via the coupling device 10 for its use via known binding systems. The at least one discharge element 5 is in turn placed in the inside of the shoe 4. Again, the first contact element 7 could be placed in the area of the sole of the shoe 2 here, which is in electrical contact with the second contact element 16 in the area of the coupling device 10 in the position of the shoe 2 coupled with the sport device 3.

As already described above, the application element 13 may in turn be placed in the sport device 3. The second contact element 16 of the coupling device 10 is connected electrically conductively to the application element 13 via the connection element or elements 11. Since a sport device 3 formed as a cross-country ski usually has no side edge 15, at least a partial section of the running surface layer 17 is to be formed as contacting surface 14, which in turn is connected electrically conductively to the application element 13.

In addition to or independently from this, it would also be possible to provide a holder opening 21 in the area of the running surface layer 17, as already described above in FIG. 5 for the sport device 3 formed as jump ski. This version is presented in dashed lines. In this holder opening 21 in turn, e.g. the ski skin 20 and/or insert 22 that then forms the contacting surface 14 can be held. The corresponding electrically conductive connection between the ski skin 20 and/or the insert 22 and the application element 13 to the connection elements 11 in turn is to be provided accordingly.

FIG. 9 shows another and possibly independent sixth embodiment of the sport system 1, again with the same reference numerals or component names being used for same parts as in the previous FIGS. 1 to 8. To avoid unnecessary repetitions, the detailed description in the preceding FIGS. 1 to 8 is noted or referred to.

This embodiment shown here also shows a cross-country ski or back-country ski as sport device 3, in which the shoe 2 and the sport device 3 are presented in the position coupled and contacted position with the contacting surface 14 placed or formed in the area of the running surface layer 17 via a coupling device 10.

The discharge element 5, which is in electrically conductive contact with the coupling element 18 placed at the shoe 2, is placed in the inside of the shoe 4 in turn. Thus, the coupling element 18 in turn forms the first contact element 7, which can be formed as a bolt or pin-shaped element. To achieve a stable attachment or coupling of the shoe 2 with the coupling device 10 on the one hand while permitting a certain swivel movement of the coupling element 18 in the coupled position in the holding receptacle of the coupling device 10 on the other hand, this embodiment has the coupling element 18 placed in the vertical direction of the longitudinal dimension of the sport device 3 and preferably in parallel alignment with the running surface layer 17 or the surface. To couple the shoe 2 with the coupling device 10, the coupling element 18 is to be inserted into a corresponding known holding receptacle of the coupling device 10 that is illustrated as a schematic here and kept latched there. The second contact element 16 may be formed by a part of the coupling device 10, in particular its holding receptacle. Since the coupling element 18 is preferably formed of an electrically conductive material, this simply permits creating an electrically conductive connection between the user's foot from the discharge element 5 through the contact elements 7, 16 to the contacting surface 14.

As already described in FIGS. 3 and 4, parts of the coupling device 10 may also be formed of an electrically conductive material or substance. Thus, an electrically conductive connection to the running surface layer 17 can be created in the further sequence via the connection element or elements 11, if applicable using the application elements 13 in between. Again, it would be possible to place the holder opening 21 in the area of the running surface layer 17 to place the ski skin 20 and/or insert 22 in it and thus bring it into contact with the connection elements 11.

FIG. 10 shows another and possibly independent seventh embodiment of the sport system 1, again with the same reference numerals or component names being used for same parts as in the previous FIGS. 1 to 9. To avoid unnecessary repetitions, the detailed description in the preceding FIGS. 1 to 9 is noted or referred to.

The sport system 1 presented here shows a crampon as sport device 3, which is usually itself formed of an electrically conductive metallic material. A climbing or alpine hiking shoe serves as the shoe 2, but a touring ski shoe or ski shoe can be used as well.

The discharge element 5 is provided in the inside of the shoe 4 in turn, with the first contact element or elements 7 placed or formed in the area of the sole of the shoe 2. The first contact elements 7 are electrically conductively in contact with the discharge element 5.

Since, as described before, the sport device 3 itself is made of an electrically conductive material, only a contact of the first contact element or elements 7 with the sport device 3, e.g. a bridge or similar, must be provided. However, it would again be possible to provide a dedicated second contact element 16 not illustrated in more detail at the sport device 3, which ensures a more independent contact with the sport device 3.

When using the shoe 2 with the sport device 3 placed on it, earthing of the user is again achieved from the inside of the shoe 4 towards the sport device 3 and the contact surface or surfaces 14 formed by this directly.

FIG. 11 shows another and possibly independent eighth embodiment of the sport system 1, again with the same reference numerals or component names being used for same parts as in the previous FIGS. 1 to 10. To avoid unnecessary repetitions, the detailed description in the preceding FIGS. 1 to 10 is noted or referred to.

The sport device 3 shown here is formed as a snow shoe. Many differently designed shoes may be used as a shoe 2, with in turn the discharge element 5 being provided in the inside of the shoe 4 and connected electrically conductively to the first contact elements 7 placed in the sole area in via an electrically conductive connection.

Most snow shoes also have claw-like parts usually formed of an electrically conductive material, which can be called crampons in the widest sense as well. They serve to prevent slipping with the snow shoes on the surface of a harder snow layer. Thus, as already described above in FIG. 10, earthing of the users is again possible from the discharge element 5 via the at least first contact element 7 to the claw-like part of the snow shoe as sport device 3. The contacting surface 14 thus forms at least the claw-like protrusions or the entire claw-like part, as it is similarly the case in the ski crampon or crampon.

Independently of this, however, it would also be possible to form an outer frame part 24 of the sport device 3 of an electrically conductive material. In the area of a shoe support 25 at the sport device 3, at least one second contact element 16 could be placed or provided across from the first contact element or elements 7. This may be electrically conductively connected to the outer frame part 24 e.g. via a line or cable. This embodiment is suggested here in the left Section of FIG. 11 in dashed lines. In this embodiment, the outer frame part 24 would form the contacting surface 14 at least in areas.

To achieve an even better contact with the terrain, a combination between the two embodiments described above for forming contacting surfaces 14 placed at a distance from each other would be possible.

FIG. 12 shows another and possibly independent ninth embodiment of the sport system 1, again with the same reference numerals or component names being used for same parts as in the previous FIGS. 1 to 11. To avoid unnecessary repetitions, the detailed description in the preceding FIGS. 1 to 11 is noted or referred to.

In this embodiment, the sport device 3 is formed as a skating skid and may, e.g., be attached directly to the shoe 2 and thus form a consistent construction unit as a sport system 1. It would also be possible to connect the skating skid to the bottom of the shoe 2 with a coupling device 10 not illustrated in more detail. Thus, different skating skids could be placed on the shoe 2 and thus connected for sport depending on application.

Again, the discharge element 5 is placed or provided in the inside of the shoe 4 and in electrically conductive contact with the first contact element 7 placed in the area of the sole. Since the sport device 3 formed as a skating skid here is itself formed of an electrically conductive material, the additional arrangement of the second contact element 16 could be dispensed with and the first contact element 7 could be directly in electrically conductively contact with the sport device 3.

If an addition coupling device 10 is provided, in turn, as described before, at least one second contact element 16 could be provided in the area of the coupling device 10, which is connected to the skid-shaped sport device 3, possible with connection elements 11 in between, and thus in electrically conductively contact with it.

The sport system 1 with the corresponding design or embodiment of the antistatic function is further targeted at creating an overall system in which not only an electrical discharge path from the shoe 2 to the contacting surface 14 of the sport device 3 is formed, possibly with the coupling device 10 in between, but also at creating a sport clothing system 26 that also comprises a continuous electrical discharge path. Thus, an electrical discharge of the electrostatic charge of the user's body and/or clothing via the electrical discharge path of the sport clothing system 26 to its shoe 2 and further to the contacting surface 14 of the sport device 3 can be achieved, depending on the individual pieces of clothing used. Below, some possible examples from a plurality of possible sport clothing systems 26 are presented and described. The shoe 2 is considered part of the sport clothing system 26 in the different embodiments.

Sole use of the sport clothing system 26 in the embodiments differing from each other is possible, with the electrical contact being directly to the terrain (earth) through the at least one first contact element 7 of the shoe 2.

Independently of this or in addition to it, shared use of the sport clothing system 26 with one of the sport devices 3 is possible as well, with the electrical contact with the terrain (earth) then created by the at least one contacting surface 14 placed or formed at the sport device 3.

FIG. 13 shows a possible embodiment of the sport system 1 which comprises the sport clothing system 26 and the sport device 3. The sport device 3 is only illustrated as an example and formed by skis in the present embodiment. The inside of the shoe 4, which serves to hold the foot of a user, is electrically conductively connected to the at least one first contact element 7 placed or formed at the outside 6 of the shoe 2. In the coupled position of the shoe 2 via the coupling device 10, the first contact element 7 comes into electrically conductive contact with the second contact element 16. At least one of the contacting surfaces 14 described above is placed or formed at the sport device 3.

The entire sport clothing system 26 preferably also comprises a continuous antistatic function, in order to discharge occurring electrostatic charges to the terrain or earth through a continuous discharge path. In the embodiment presented completely here, the sport clothing system 26 comprises an outer clothing 27, the shoe or shoes 2, a safety helmet 28, possibly protection goggles 29 and finger clothing 30. It should be mentioned that the above parts or components of the sport clothing system 26 will be described in more detail below for different types of sports. Furthermore, the sport clothing system 26 can also comprise different footwear 31, which is not presented in more detail here but shown and described in one of the following figures. This includes socks, stockings or similar.

In this embodiment, the outer clothing 27 is formed of an upper body clothing 32 and leg clothing 33. The outer clothing is mostly worn on the torso, arms and legs.

The outer clothing 27 comprises at least one electrically conductive layer 34 at least in sections, which is schematically suggested by a dashed cross-hatch. The at least one electrically conductive layer 34 is further electrically conductively connected to the contact element 7 placed or formed at the shoe 2 through a discharge path that is illustrated simplified. This shoe 2 or these shoes 2 illustrated here also comprise at least one first contact element 7 placed or formed at the outside 6, which with the user's foot to be held in the shoe 2 can be electrically conductively connected.

If the outer clothing 27 is formed by the upper body clothing 32 and the leg clothing 33 as in the present embodiment, both pieces of clothing 32, 33 comprise the at least one electrically conductive layer 34 at least in sections. Furthermore, the upper body clothing 32 is then electrically conductively connected to the leg clothing 33, in particular its respective electrically conductive layers 34, as is possible by a connection line 35 suggested with a line. Thus, a direct electrically conductive connection is created as a discharge path from the upper body clothing 32 to the leg clothing 33, e.g. the trousers.

Based on the outer clothing 27, in particular the leg clothing 33, the electrical discharge path may be formed towards the first contact element 7 of the shoe 2.

In the left area of the leg clothing 33, a possible embodiment is shown in which the electrically conductive connection takes place from the outer clothing 27 via the inner shoe 9 held in the shoe 2 and formed electrically conductively at least in sections to the first contact element 7. For this, in turn, the conductive connection can be established via the connection line 35. It should be mentioned that the connection line 35 may be placed or formed between many different pieces of clothing.

In the area of the stub of the leg clothing 33 shown on the right, another connection option for the formation of the discharge path from the outer clothing 27 to the first contact element 7 is shown. For this, the connection line 35 runs from the outer clothing 27, in particular its conductive layer 34, to the discharge element 5 placed inside the shoe 4. In this embodiment, the discharge element can be formed e.g. by the inner sole. The inner sole is also formed electrically conductively and in turn is further electrically conductively connected to the first contact element 7 of the shoe 2.

The sport clothing system 26 may also comprise finger clothing 30 as a further piece of clothing or clothing. Thus, the finger clothing 30 may comprise at least one electrically conductive layer 36 at least in sections or be formed by this electrically conductive layer 36, as suggested in a partial section. The electrically conductive layer 36 of the finger clothing 30 can in turn form the discharge path to the outer clothing 27 with many differently formed conductive connections.

In the left area of the sleeve of the upper-body clothing 32, it is shown that the at least one electrically conductive layer 36 of the finger clothing 30 is connected electrically conductively to the outer clothing 27, in particular to its electrically conductively formed layer 34, via the connection line 35.

If the finger clothing 30 is itself formed by the electrically conductive layer 36, the separate arrangement of the connection line 35 can be dispensed with, with the electrically conductive connection for formation of the discharge path then being achieved by an electrically conductive sleeve end 37 to the electrically conductive layer 34 of the outer clothing 27. For this, the sleeve end 37 at the inside of the sleeves is applied with the electrically conductively formed layer 34 or formed by it. The electrically conductive layer 34 of the sleeve end 37 in turn is electrically conductively connected to layer 34 of the outer clothing 27, in particular of the upper body clothing 33.

As already described above, the sport clothing system 26 may also comprise the safety helmet 28. To create an electrically conductive connection for forming the discharge path again, the safety helmet 28 may be applied at least in sections with an electrically conductive layer 39 or equipped with it at its outer surface 38. In the right shoulder area of the outer clothing 27, it is illustrated simplified that the electrically conductively formed layer 39 of the safety helmet 28 is connected electrically conductively to the outer clothing 27, in particular its electrically conductive layer 34, by at least one connection line 35.

The protection goggles 29 may comprise a glasses lace 40 or side pieces. The glasses lace 40 or the side pieces can also be formed electrically conductively and are electrically conductively connected to the electrically conductive layer 39 placed or formed at the outer surface 38 of the safety helmet 28 in intended use. This permits producing a continuous electrically conductive connection to form the discharge path to the electrically conductively formed first contact element 7 of the shoe 2 from the protection goggles 29, in particular the lenses, via the glasses lace 40 or the side pieces.

FIGS. 14 and 15 show two possible embodiments of the outer clothing 27 for formation of the sport clothing system 26, again with the same reference numerals or component names being used for same parts as in the previous FIGS. 1 to 13. To avoid unnecessary repetitions, the detailed description in the preceding FIGS. 1 to 13 is noted or referred to. The difference is only that FIG. 14 shows and describes a two-part and FIG. 15 a single-part embodiment of the outer clothing 27.

The outer clothing 27 illustrated in FIGS. 14 and 15 in turn comprises at least the electrically conductive layer 34 described above or is formed by it. In the case of a two-part embodiment of the outer clothing 27, i.e. the separate upper body clothing 32 and the separate leg clothing 33, the electrical connection between these two pieces of clothing 32, 33 takes place through the connection line 35. It should be mentioned that the connection line 35 is only schematically suggested and can be implemented by any embodiment. To produce the connection line 35, in particular for its contact with the electrically conductive layers 34 placed in the upper body clothing 32 and the leg clothing 33, the corresponding state-of-the art electrical plug-in and/or coupling connections can be used.

In the area of the right shoulder of the outer clothing 27, in particular of the upper body clothing 32, it is also shown that, if the safety helmet 28 may be used for sports with the protection goggles 29, an electrically conductive connection device 41 for production of the electrically conductive connection may be placed or formed there. The connection device 41 may, e.g., be formed by a plug connection or similar, with which the connection line 35 connected to the safety helmet 28 can be electrically conductively connected, and in particular coupled.

In the area of the leg end, the connection line 35 for connection to the shoe 2 and/or the inner shoe 9 is also suggested simplified. Again, a correspondingly formed electrical connection device 41 can be placed or formed here. The same also applies to the mutual connection between the upper body clothing 32 and the leg clothing 33. The electrically conductive layer 34 is presented here as well by the simplified suggested cross-hatch.

In contrast to the embodiment of FIG. 14, FIG. 15 shows the outer clothing 27 formed of a single piece, i.e. in the form of overalls or similar. The separate electrical connection line 35 between the upper body clothing 32 and the leg clothing 33 can be dispensed with there. Because of this, the electrically conductive layer 34 is preferably formed at the outer clothing 27 continually on its full surface. In the area of the leg clothing 33 of the outer clothing 27 illustrated here on the right, the electrical connection device 41 with the connection line 35 connected to it for the further electrically conductive connection to the first contact element 7 is additionally illustrated simplified.

The outer clothing 27 presented here in the two FIGS. 14 and 15 may, e.g., be used for alpine skiing, touring skiing, expeditions or similar.

FIG. 16 shows another possible embodiment of the outer clothing 27 for formation of the sport clothing system 26, again with the same reference numerals or component names being used for same parts as in the previous FIGS. 1 to 15. To avoid unnecessary repetitions, the detailed description in the preceding FIGS. 1 to 15 is noted or referred to.

The embodiment of the outer clothing 27 presented here is formed similarly to the embodiment described before in FIG. 15. The outer clothing 27 is formed of a single part and comprises the at least one conductive layer 34. This in turn may cover the entire outer clothing 27 on the full surface. In this, it is of benefit if the electrically conductive layer 34 itself forms the outer clothing 27.

In the area of the shoulder illustrated here on the right the connection device 41 described before is placed or formed in turn, with the possibility of connecting this to the safety helmet 28 and/or the protection goggles 29 via the connection line 35 if applicable.

The outer clothing 27 illustrated here may be used, e.g., for alpine racing, touring races, bobsled and toboggan sports or similar sports. Further, it is shown here that additional holding loops, in particular for the thumb, are placed or formed in the area of the sleeve end 37. This permits better fastening of the sleeve to the arm, and in particular the thumb of the user.

Further, it is also shown here in the area of the leg illustrated on the right that the connection device 41 can in turn be placed or provided here with the connection line 35 that can be connected to it. Thus, the layer 34 can be used to produce a corresponding electrically conductive connection to the first contact element 7 of the shoe 2.

FIGS. 17 and 18 show two further possible embodiments of the sport clothing system 26 comprising the outer clothing 27, footwear 31 and shoes 2, again with the same reference numerals or component names being used for same parts as in the previous FIGS. 1 to 16. To avoid unnecessary repetitions, the detailed description in the preceding FIGS. 1 to 16 is noted or referred to.

The embodiments of the outer clothing 27 shown here each comprise a two-part form and comprise the upper body clothing 32 and the leg clothing 33. The two pieces of clothing 32 and 33 forming the outer clothing 27 are in turn formed by the electrically conductive layer 34. In this, a contact in the form of the connection line 35 between the upper body clothing 32 and the leg clothing 33 can be dispensed with. The footwear 31 can be formed as a sock or football sock. This material for formation of the footwear 31 can also be directly electrically conductively formed by another electrically conductively formed layer 42. Thus, a direct contact of the footwear 31 to the electrical discharge element 5 placed inside the shoe 4 is possible.

In the embodiment illustrated in FIG. 17, the leg clothing 33 is formed as trousers with long legs. This embodiment can also be called a "longpant".

In contrast to this, the leg clothing 33 in FIG. 18 is formed as trousers with short leg stubs. This embodiment can be called "short trousers" in the sport area.

Since both the leg clothing 33 and the foot clothing 31 are themselves electrically conductively formed according to FIG. 17, an arrangement of connection lines 35 can be dispensed with here as well.

In contrast to this, as now shown in FIG. 18, a connection line 35 between the short leg stubs of the leg clothing 33 and the footwear 31 each is suggested by double lines. These may, e.g., be electrical connection lines placed directly on the body of the user, in particular glued on. They then ensure that a continuous discharge path from the upper body clothing 32 to the first contact element 7 of the shoe 2 can be produced.

Furthermore, the shoe 2 illustrated on the right respectively in the area of the shoes 2 in the two FIGS. 17 and 18 is formed with spikes or stubbles, each of which protrude over the sole of the shoe 2. These spikes or stubbles represent or form the first contact element 7 in an embodiment.

In the shoes 2 illustrated on the left in FIGS. 17 and 18 respectively, no spikes or stubbles are provided, but at least a partial section of the sole of the shoe 2 is formed electrically conductively. This at least electrically conductive partial section of the sole forms the first contact element 7.

Thus, a continuous electrically conductive discharge path can be formed even if no sport device 3 is used additionally.

The sport clothing system 26 illustrated in FIGS. 17 and 18 may be used for many different ball sports, such as soccer, rugby, football, golf, cricket or baseball. This may also be used, however, for tennis, badminton, squash, indoor football, handball, basketball or similar. It may, however, also be used for other sports not explicitly named here.

FIG. 19 shows another possible embodiment of the outer clothing 27 for formation of the sport clothing system 26, again with the same reference numerals or component names being used for same parts as in the previous FIGS. 1 to 18. To avoid unnecessary repetitions, the detailed description in the preceding FIGS. 1 to 18 is noted or referred to.

The embodiment of the sport system 1 illustrated here, in particular its sport clothing system 26, shows a part of the outer clothing 27 and a part of the safety helmet 28, which has been illustrated in a section and enlarged.

The outer clothing 27 can be formed as already illustrated and described above in FIGS. 13 to 16. Every possible combination with the outer clothing 27 differently formed there is possible.

The safety helmet 28 may comprise a different structure, with it possibly being formed in the embodiment illustrated here by an outer helmet shell 43, possibly a layer of a damping material 44, and an electrically conductively formed layer 46 facing a head-holding space 45. The electrically conductive layer 46 can be connected to the damping material 44. Through the bilateral placement of the electrically conductive layers 39 and 46, an electrostatic charge can be discharged from the outer surface 38 as well as the area of the head-holding space 45 via the electrical connection line 35, possibly with the electrical connection device 41 and the outer clothing 27 in between, and in particular its conductive layer 34.

The electrical contact of the safety helmet 28 and the protection goggles 29 that may be placed on it with the electrically conductively formed glasses lace 40 may, e.g., be used for alpine skiing and touring, snowboarding, in expeditions, bobsledding, skeleton and toboggan sports.

The electrically conductive layer 39 described above can be formed of many different materials as required. It would therefore also be possible to form the layer 39 of an electrically conductive varnish and/or a plastic layer with electrically conductive characteristics. The electrically conductively formed layer 46 facing the head-holding space 45 can be formed of a textile flat part. The textile part can, e.g., also be formed by a spacer structure, in particular a spacer knit. Further, this could also be formed by single-layer and/or multi-layer fabrics, meshes, knits, nonwovens or similar.

FIGS. 20 and 21 show two further possible embodiments of the sport clothing system 26, specifically different embodiments of finger clothing 30, again with the same reference numerals or component names being used for same parts as in the previous FIGS. 1 to 19. To avoid unnecessary repetitions, the detailed description in the preceding FIGS. 1 to 19 is noted or referred to. The finger clothing 30 can be formed by a glove, mittens or similar.

As already described above in FIG. 13, the finger clothing 30 itself may be formed by the electrically conductive layer 36. Therefore, a detailed illustration of the finger clothing 30 for this embodiment is dispensed with. In this embodiment, it is essential that both the inner surface and the outer surface of the finger clothing 30 continuously comprises the electrically conductive layer 36 and/or is formed by it. If, e.g. two continuously formed electrically conductive layers 36 are provided and an insulating layer is placed between them, the two electrically conductive layers 36 placed or formed at the inner surface and the outer surface must be brought into contact with each other.

The finger clothing 30 presented in FIG. 20 may also be part of the sport clothing system 26 for formation of the sport system 1.

In contrast to the embodiment of the finger clothing 30 only described above, the embodiment illustrated here has the electrically conductive layers 36 placed or formed at the side of the finger clothing 30 facing the palm of the user only in sections. The electrically conductive layers 36 placed distributed cross the surface may, e.g., only be placed or formed at the insides of the fingers and/or in the area of the palm. In the wrist area of the finger clothing 30, it is further shown that the electrical connection device 41 described before can be placed here. Starting here, a corresponding electrical discharge path to the outer clothing 27, in particular its electrically conductive layer 34, can be created by the connection line 35.

The electrically conductive layers 36 placed distributed over the surface are electrically conductively connected to the connection device 41 in the present embodiment via dedicated contacting lines 47. The arrangement and embodiment of the contacting lines 47 can be any, but an arrangement within the material for formation of the finger clothing 30 is preferred.

In the embodiment of the finger clothing 30 illustrated in FIG. 21, only the type of contacting from the electrically conductive layers 36 placed distributed in the area of the palm to the piece of clothing of the outer clothing 27, in particular the upper body clothing 32, is chosen differently from the embodiment described in FIG. 20. In the embodiment of FIG. 21, the wrist area of the finger clothing 30 is also applied with the electrically conductive layer 36 or formed by it in the area of its outer surface. The electrically conductive layers 36 placed in the area of the palm and/or the fingers are again electrically conductively connected to the electrically conductive layer 36 placed in the wrist area via the contacting lines 47. It is possible to electrically conductively connect the individual contacting lines 47 directly to the electrically conductive layer 36 placed or formed in the wrist area. It would, however, also be possible to provide the electrically conductive connection device 41 here, too, which is electrically conductively connected to the contacting lines 47 on the one hand and the electrically conductive layer 36 placed in the wrist area on the other hand. The connection device 41 is illustrated simplified in dashed lines.

With the finger clothing 30 illustrated in FIG. 21, the contact to the piece of clothing of the outer clothing 27, in particular the upper body clothing 32, can be established as shown in FIG. 13 in the area of the sleeve illustrated on the right.

FIGS. 22 to 26 show different embodiments and arrangement options of the electrically conductive layer 34 for formation of pieces of clothing of the outer clothing 27, in particular of upper body clothing 32 and/or leg clothing 33, wherein again the same reference numerals or component names are being used for same parts as in the previous FIGS. 1 to 21. To avoid unnecessary repetitions, the detailed description in the preceding FIGS. 1 to 21 is noted or referred to.

In the embodiment illustrated in FIG. 22, the material for formation of the piece of clothing of the outer clothing 27 itself is formed by the electrically conductive layer 34. Thus, a continuous electrical discharge path can be created both from the user and thus the inside of the material, and from the outside of the material. In this embodiment, the electrically conductively formed layer 34 can also be called the upper material.

In the embodiment illustrated in FIG. 23, the at least one electrically conductive layer 34 of the outer clothing 27 is supported by an inner material 48 at least in sections on an inside that can be turned towards the user. The material of the inner material 48 can be chosen as desired, with this not comprising any electrically conductive characteristics. In this embodiment illustrated here, the electrically conductively formed layer 34 also forms the upper material of the piece of clothing of the outer clothing 27.

In the embodiment illustrated in FIG. 24, the at least one electrically conductive layer 34 of the outer clothing 27 does not form the upper material of the clothing. Here, the at least one electrically conductively formed layer 34 of the outer clothing 27 is covered by an outer layer 49. The at least one electrically conductively formed layer 34 may, if applicable, additionally be supported by the inner material 48 described above at least in sections on the inside facing away from the outer layer 49.

The embodiments of the layer structure for formation of pieces of clothing of the outer clothing 27 described in FIGS. 22 to 24 are usually used in alpine racing, bobsledding, skeleton sport, toboggan sport and possibly cross-country sport.

In the embodiment illustrated in FIGS. 25 and 26, a multi-layered structure for formation of pieces of clothing of the outer clothing 27, in particular of upper body clothing 32 and/or leg clothing 33, is shown. Due to the multi-level or multi-layered structure, better insulation and/or damping properties can be achieved in particular in winter sports.

In the embodiment illustrated in FIG. 25, the outer layer and thus the upper material is formed by the electrically conductive layer 34. The inner-most layer facing the body in turn forms the inner material 48. On the side of the upper material formed by the electrically conductive layer 34 that is facing the inner material 48, one, but preferably also several, interim layers 50 can be placed. These may be different "blocker-layers". These may, e.g., protect the user from the effects of air flows and/or moisture.

Additionally, it is shown here that at least one insulating layer 51 can be placed on side of the inner material 48 facing the electrically conductive layer 34. This creates a layer structure of the upper material, specifically the electrically conductive layer 34, the at least one interim layer 50, the insulating layer 51 and the inner material 48.

In the embodiment illustrated in FIG. 26, it is also shown that the layer structure for formation of pieces of clothing of the outer clothing 27 is formed according to the one described above in FIG. 25. The electrically conductive layer 34 forming the upper material before, however, is additionally covered by the outer layer 49 here, which forms the upper material in the present embodiment. The entire layer structure thus comprises, from the upper material to the inside, the outer layer 49, the electrically conductively formed layer 34, at least one interim layer 50, the insulating layer 51 and the inner material 48 as the inner-most layer or level. this may also be called the lining layer.

FIGS. 27 to 33 show possible embodiments of different sport devices 3 for formation of the sport system 1, wherein again a combined use with the sport clothing system 26 is of benefit. Again, the same reference numerals or component names as in the previous FIGS. 1 to 26 are used for the same parts. To avoid unnecessary repetitions, the detailed description in the preceding FIGS. 1 to 26 is noted or referred to. These following further sport devices 3 also comprise an antistatic function and are thus also equipped with an electrically conductive discharge path. This permits grounding.

To ground a user while using many different sport devices 3 and thus creating an electrically conductive discharge path, further sport devices 3 are shown and described as examples in addition to the sport devices 2 already illustrated in FIGS. 1 to 12 above. Since the sport devices 3 described below usually do not permit any direct contact of the user via the shoe or shoes 2 to the sport device 3 and its contacting surface 14, further options for formation of the electrical discharge path are listed here as examples.

FIG. 27 shows the sport device 3 in the form of a bob sledge, which is also called a "bob-sleigh". The size of the bob sledges is determined by the number of persons. The sport device 3 formed as a bob sledge comprises a basic body 52 and at least one basic element 53 placed or formed at the basic body 52 in this embodiment. The basic element 53 serves at least temporarily for being supported on a terrain when used by the user.

In this embodiment, the basic body 52 comprises at least one cladding element 54 and struts, reinforcement parts and connection components that are not illustrated in any more detail. The basic body 52, in the present embodiment the cladding element 54, comprises at least one electrically conductive layer 55 at least in sections or is formed by the electrically conductive layer 55 at least in sections. The electrically conductive layer 55 is preferably placed in the entire area of the outside or an outer surface 56 of the basic body 52 or forms the outer surface.

The basic element 53 is formed by skids formed in the present embodiment. Preferably, an electrically conductively material is chosen for the basic element 53, with this forming the at least one contacting surface 14. If the skids forming the basic element 53 are not made of any electrically conductive material, the contacting surfaces 14 must be formed, e.g., by electrically conductive insertion elements or similar.

To form the electrical discharge path, the at least one electrically conductive layer 55 which is placed or formed at the basic body 52 is electrically conductively connectable or connected to the contacting surface 14 of the basic element 53. This conductive connection is suggested simplified by lines.

A carrying frame 57 can be placed as a connection or holder between the basic body 52 and the basic element 53, which is also part of the sport device 3. The carrying frame 57 may also be called the chassis.

In addition to this, the basic body 52 can also comprise at least one supporting element 58 for the user or users. The supporting element 58 comprises a supporting area 59 that is or can be turned towards the user. The supporting area 59 comprises an electrically conductive layer 60 or the supporting element 58 is formed by the electrically conductive layer 60 at least in sections.

When using the antistatic sport clothing system 26 described above, in particular if the upper material is formed by the electrically conductive layer 34 or comprises it, a contact of the user with the electrically conductive layer 60 is thus possible when he supports himself on the supporting area 59. Subsequently, the electrically conductive layer 60 of the supporting elements 58 is also electrically conductively connected to the contacting surface 14 of the basic element 53. Thus, both an electrostatic charge of the basic body 52 and of the user can be discharged via the supporting element 58 to the contacting surface 14 and thus to the earth.

FIGS. 28 and 29 show that the sport device 3 can be formed, e.g., by a skeleton sledge—FIG. 28—or a toboggan, in particular a luge—FIG. 29. These two sport devices 3 also may in turn be part of the antistatically formed sport system 1.

The sport device 3 formed as a skeleton sledge also comprises the basic body 52 that is applied with the electrically conductive layer 55 at least in sections of its outside or its outer surface 56 or formed by the electrically conductive layer 55 at least in sections of its outside formed. On the basic body 52, the basic element 53 in the form of skids, in particular of an electrically conductive material, is placed and in particular attached to it, on the side that is or can be turned towards the terrain. On the side facing the user, the skeleton sledge can also in turn comprise at least one supporting element 58, wherein also in turn it is applied with the electrically conductive layer 60 at least in sections of its supporting area 59 facing the user or is formed of it in sections.

In this embodiment, the electrically conductive layer 55 of the basic body 52 and the electrically conductive layer 60 of the supporting element 58 are connected to each other electrically conductively. The electrically conductive layers 55, 60 are in turn electrically conductively connected to the contacting surface 14 placed and formed at the basic element 53.

Since the embodiment of the sport device according to FIG. 29 is very similar to the one already described above in FIG. 28, it will not be dealt with in more detail here.

The embodiments of the sport device 3 described above in FIGS. 27 to 29 are in direct contact with the terrain via their skids, with the skids being formed of an electrically conductive material, in particular a metallic material. Thus, a single contact per skid is usually sufficient.

FIG. 30 shows the board-like sport device 3 simplified in cross-section, wherein this again is formed of the basic body 52 and the basic element 53 with the contacting surface or surfaces 14 placed and formed on it. For the sake of simplicity, detailed illustration of the inner layer structure was dispensed with. The contacting surface 14 can here be formed by at least one of the side edges 15 and/or the running surface layer 17, which form the basic element 53 together.

At the outer surface 56 of the basic body 52, the electrically conductive layer 55 may be placed or formed in turn, which is electrically conductively connected to at least one of the contacting surfaces 14, e.g. via the application element 13 placed on the inside.

The previously described electrically conductive layer 55 may be formed of many different materials as required. Thus, it would be possible that the layer 55 is formed of an electrically conductive varnish, a plastic layer, a netting, mesh, knit and/or fabric of electrically conductive threads or fibers placed in the area of the outer surface 56. Since the basic body 52, in particular its connection element 54, is usually formed of a plastic material, which may also be reinforced with at least one insertion layer, the electrically conductive layer 55 formed of a flat material may be embedded in the plastic material as well or held on it by it.

In FIGS. 31 and 32, the sport device 3 of the sport system 1 is formed as a pole, in particular a ski pole.

According to the illustration of FIG. 31 the basic body 52 is pole-shaped and comprises a grip element 61 placed and formed on it additionally and a loop 62. In this embodiment, both the grip element 61 and the loop 62 are formed electrically conductively or applied with an electrically conductive layer not further specified.

The pole-shaped basic body 52 preferably comprises a tip 63 at its end facing away from the grip element 61, which is preferably formed of an electrically conductive material. Thus, the tip 63 forms the basic element 53 in the present embodiment, which in turn forms the contacting surface 14. As schematically suggested by a line, the grip element 61 is electrically conductively connected to the by basic element 53 formed by the tip 63 via the basic body 52.

Thus, it would be possible, e.g., to form the basic body 52 itself of an electrically conductive material or to create a separate electrically conductive connection as it is illustrated by the connection line 35 suggested by the line.

The embodiment of the sport device 3 illustrated in FIG. 32 with the pole-shaped basic body 52 only has the electrically conductive connection device 41 described before placed in the area of the loop 62. Thus, it is possible to create an electrically conductive connection from the area of the loop 62 to the contacting surface 14 via the electrical connection line 35 that may be placed and/or formed in the basic body 52.

The contact of the electrically conductive connection device 41 in the area of the loop 62 can be achieved, e.g., with the finger clothing 30 or a further dedicated electrical connection line 35 to a piece of clothing of the outer clothing 27, in particular the upper body clothing 32.

In the area of the end of the pole-shaped basic body 52 facing away from the grip element 61, it is also suggested that the contacting surface 14 can be formed by a contact element 64 placed on the tip 63. This contact element 64 may, e.g., be formed of an electrically conductive plastic, to avoid direct hard contact of the tip 63 usually formed of an metallic material with the terrain. The contact element 64 may, e.g. be used in walking poles.

FIG. 33 shows a further sport device 3 in the form of a board-like sliding device simplified in cross-section, wherein this is also formed of the basic body 52 and the basic element 53 with the contacting surface or surfaces 14 placed and formed on it. For simplicity, detailed illustration of the possible inner layer structure was dispensed with. The at least one contacting surface 14 in this embodiment is to the major share formed by at least one of the side edges 15. The running surface layer 17, which is usually formed of a plastic material, can be formed electrically conductively at only a small part by additives or integrated and/or embedded additional materials such as graphite or other electrically conductive materials. A higher, share of, e.g., graphite, will not only lead to better or higher sliding properties and electrical conductivity, but also reduce strength characteristics and resilience when riding, in particular at impacts or contact with hard objects (rocks, etc.).

Thus, in the sport device 3 that is board-like here, the two side edges 15 and the running surface layer 17 form the basic element 53. A leg part of the side edge 15 protrudes over a partial section of the running surface layer 17 in the direction of the respective other side edge 15. The board-like sport device 3 may, e.g., be formed by an alpine ski, cross-country ski, back-country ski, jump ski, touring ski or a snowboard—also in divided form. The running surface layer 17 comprises a sliding surface 65 that can be turned towards the terrain and a rear surface 66 facing the basic body 52. At least one of the two side edges 15 and the running surface layer 17 are or can be supported on the terrain by the user in use at least temporarily depending on the relative position of the sport device 3 to the terrain.

At least one of the side edges 15—but preferably both side edges 17—form one contacting surface 14 that can be turned towards the terrain each here. Furthermore, at least one contacting element 67 formed of an electrically conductive material can be placed between the rear surface 66 of the running surface layer 17 and the basic body 52 at least in sections. The contacting element or elements 67 are preferably formed flat. Materials may not only be metallic materials such as copper, aluminum, titanium or similar, but also electrically conductive plastics. The running surface layer 17 is in turn electrically conductively connected with the contacting element or elements 67 and further the contacting element or elements 67 to the contacting surface 14 formed by the at least one side edge 15 by one or several discharge paths.

The electrically conductive discharge path between the running surface layer 17 and the at least one contacting element 67 may, e.g., be formed by an electrically conductive glue layer 68. The glue layer 68 may be formed partially and/or on the full area.

The basic body 52 may preferably comprise at least one electrically conductive layer 55 at its outside or its outer surface 56 at least in sections or be formed by at least the one electrically conductive layer 55 at its outside at least in sections. The at least one electrically conductive layer 55 is electrically conductively connected to the at least one contacting surface 14 and/or the at least one contacting element 67 through a discharge path.

Further, at least one application element 13 formed of an electrically conductive material can be placed in the inside of the basic body 52, as it was already described in more detail above. The at least one application element 13 can preferably be placed in at least one attachment area 12 provided for attachment of the coupling device 10. The application element or elements 13 can be electrically conductively connected to the side edge 15 or its contacting surface 14 and/or the at least one contacting element 67. Further, however, the application element or elements 13 may be electrically conductively connected to the at least one electrically conductively formed layer 55 at the outside of the basic body 52 as well. All of these electrically conductively formed connections described above may form partial sections of the electrical discharge path or paths. The individual electrically conductive connections are only suggested simplified by different lines.

FIG. 34 shows a further sport device 3 in the form of a board-like sliding device simplified in cross-section, with this also being formed of the basic body 52 and the basic element 53 with contacting surface or surfaces 14 placed and formed on it. For simplicity, detailed illustration of the possible inner layer structure was dispensed with. The at least one contacting surface 14 is also formed to a major share by at least one of the side edges 15 in this embodiment.

Thus, the two side edges 15 and the running surface layer 17 form the basic element 53 in the sport device 3 that is board-like here as well. The at least one contacting surface 14 that can be turned towards the terrain is also formed by an outer or edge partial section of the side edges 15 here.

In contrast to the embodiment described above in FIG. 33, the at least one contacting element 67 covers nearly the same width of the running surface layer 17 of the sport device 3 and is thus backed or overlapped on both sides in the area of the side edges 15 by one leg part of the same each. Between the rear surface 66 of the running surface layer 17 that faces the basic body 52 and the at least one contacting element 67 in turn, the electrically conductively formed glue layer 68 may be placed. Further, the glue layer 68 can also be placed in the area of side faces 69 of the contacting element 67 and in addition to this also between the leg part or parts of the side edges 15 and the contacting element 67. Thus, a direct electrical contact of the running surface layer 17 can be formed with the at least one contacting element 67 via the glue layer 68 to the at least one side edge 15 and its contacting surface 14 or contacting surfaces 14, without having to provide additional conductive connections. The glue layer 68 was entered only with a thicker line for better overview and encloses the contacting element 67 at its side facing the running surface layer 17 in cross-section, and further via the side faces 69 to the leg parts of the side edges 15 overlapping contacting element 67.

To achieve a height compensation with the leg parts of the side edges 15, the basic element 53 and/or the basic body 52 may comprise an interim layer not described in more detail.

The embodiments described above, specifically the at least one electrically conductively formed layer 55 preferably placed at least in sections at the outside or the outer surface 56 and/or the at least one application element 13, which is preferably placed in the attachment area 12 of the coupling device 10 not illustrated in more detail, with their different mutual contacting options can be done accordingly as described above in FIGS. 30 and 33.

Independently of this, however, it would also be possible to form the contacting element or elements 67 directly by the electrically conductive glue layer 68. Thus, electrically conductive particles could be embedded in the glue layer 68 in addition to the adhesive. This way, the electrostatic charge of the running surface layer 17 could be discharged directly via the glue layer 68 forming the at least one contacting element 67 to the side edges 15 and their contacting surfaces 14. This embodiment would be of great benefit, since the entire running surface layer 17, in particular its rear surface 66, would be nearly completely to completely connected to the basic body 52 on the one hand by its surface, while on the other hand creating a large-area electrically conductively discharge path.

The embodiments show possible embodiment versions of the sport system 1; it should be noted here that the invention is not limited to the specifically illustrated embodiment versions of the same, but that rather various combinations of the individual embodiment versions among each other are possible as well, and this variation option is within the skill of the specialist working in this technical field according to the teachings on technical action by this invention.

Further, individual characteristics or characteristic combinations from the different embodiments illustrated and described can also represent independent, invention solutions or solutions according to the invention.

The task underlying the independent invention solutions can be taken from the description.

In particular, the individual embodiments shown in in FIG. 1, 2; 3, 4; 5; 6, 7; 8; 9; 10; 11; 12; 13; 14; 15; 16; 17; 18; 19; 20; 21; 22; 23; 24; 25; 26; 27; 28; 29; 30; 31; 32; 33; 34 can be the object of independent solutions according to the invention. The tasks and solutions according to the invention in this respect can be taken from the detailed descriptions of these figures.

For reasons of formality, it is finally noted that the sport system 1 or its parts are partially presented not to scale and/or enlarged and/or reduced for better understanding of its structure.

| List of Reference Numerals | |
|---|---|
| 1 | Sport system |
| 2 | Shoe |
| 3 | Sport device |
| 4 | Inside of the shoe |
| 5 | Discharge element |

-continued

| List of Reference Numerals | |
|---|---|
| 6 | Outside |
| 7 | First contact element |
| 8 | Shell |
| 9 | Inner shoe |
| 10 | Coupling device |
| 11 | Connection element |
| 12 | Attachment area |
| 13 | Application element |
| 14 | Contacting surface |
| 15 | Side edge |
| 16 | Second contact element |
| 17 | Running surface layer |
| 18 | Coupling element |
| 19 | Coupling pin |
| 20 | Ski skin |
| 21 | Holder opening |
| 22 | Insert |
| 23 | Attachment element |
| 24 | Outer frame part |
| 25 | Shoe support |
| 26 | Sport clothing system |
| 27 | Outer clothing |
| 28 | Safety helmet |
| 29 | Protection goggles |
| 30 | Finger clothing |
| 31 | Foot clothing |
| 32 | Upper body clothing |
| 33 | Leg clothing |
| 34 | Layer |
| 35 | Connection line |
| 36 | Layer |
| 37 | Sleeve end |
| 38 | Surface |
| 39 | Layer |
| 40 | Glasses lace |
| 41 | Connection device |
| 42 | Layer |
| 43 | Helmet shell |
| 44 | Damping material |
| 45 | Head-holding space |
| 46 | Layer |
| 47 | Contacting line |
| 48 | Inner material |
| 49 | Outer layer |
| 50 | Interim layer |
| 51 | Insulating layer |
| 52 | Basic body |
| 53 | Basic element |
| 54 | Connection element |
| 55 | Layer |
| 56 | Outer surface |
| 57 | Carrying frame |
| 58 | Supporting element |
| 59 | Supporting area |
| 60 | Layer |
| 61 | Grip element |
| 62 | Loop |
| 63 | Tip |
| 64 | Contact element |
| 65 | Sliding surface |
| 66 | Rear surface |
| 67 | Contacting element |
| 68 | Glue layer |
| 69 | Side face |
| 70 | Cable |

The invention claimed is:

1. A sport system with antistatic function, the sport system comprising:

a) a shoe with a first contact element placed or formed at its outer side, with this first contact element being electrically conductively connectable to a foot of a user to be held in the shoe;

b) a board-shaped sport device, having an attachment area comprising a basic body of non-electrically conductive material and a basic element placed or formed on the basic body, the basic element comprising a running surface layer and a side edge made of an electrically conductive material, wherein the running surface layer comprises a sliding surface and a rear surface facing the basic body, wherein the basic element is configured to be supported on a terrain at least temporarily and the side edge forms a contacting surface that can be turned towards the terrain;

c) a contacting element made of an electrically conductive material and placed between the rear surface of the running surface layer and the basic body at least in sections, wherein the running surface layer is electrically conductively connected to the contacting element and the contacting element is electrically conductively connected to the contacting surface formed by the side edge by a discharge path;

d) an attachment element disposed inside the board-shaped sport device in the attachment area and electrically conductively connected to the contacting surface; and e) a coupling device placed in the attachment area of the board-shaped sport device as a holder for the shoe in a coupled position and a connection element connecting the coupling device to the board-shaped sport device, wherein the connection element is made of an electrically conductive material, is connected to the attachment element, and is in contact with the first contact element of the shoe in the coupled position, wherein the first contact element of the shoe is electrically conductively connected via the discharge path to the contacting surface of the board-shaped sport device, which contacting surface can be turned towards the terrain.

2. The sport system according to claim 1, wherein the discharge path between the running surface layer and the contacting element is formed by an electrically conductive glue layer, with this glue layer being formed partially or on A full surface.

3. The sport system according to claim 1, wherein the contacting element is formed by an electrically conductive glue layer.

4. The sport system according to claim 1, wherein the basic body has at least one electrically conductive layer at least in sections at its outer side or is formed by at least one electrically conductive layer at least in sections at its outer side, and wherein the at least one electrically conductive layer is electrically conductively connected to the contacting surface and/or the contacting element via a discharge path.

5. The sport system according to claim 1, wherein an application element made of an electrically conductive material is provided at and/or within the board-shaped sport device at least in the attachment area intended for attachment of the coupling device, with this application element being electrically conductively connected to the contacting surface and/or the contacting element.

6. The sport system according to claim 1, wherein the board-shaped sport device is chosen from the group consisting of alpine ski, cross-country ski, back-country ski, jumping ski, touring ski, and snowboard.

7. The sport system according to claim 1, wherein the contacting surface in the board-shaped sport device is formed by at least one partial section of the running surface layer made of an electrically conductive material.

8. The sport system according to claim 1, wherein an application element made of an electrically conductive material is provided at and/or within the sport device at least in the attachment area of the coupling device, with this application element being electrically conductively connected to the contacting surface.

9. The sport system according to claim 1, wherein a second contact element is placed or formed at the coupling device, which second contact element is in contact with the first contact element of the shoe in the coupled position with the shoe.

10. The sport system according to claim 8, wherein a second contact element of the coupling device is electrically conductively connected to the application element.

11. The sport system according to claim 8, wherein a second contact element of the coupling device is connected electrically conductively to the application element via electrically conductive components of the coupling device and via the connection element.

12. The sport system according to claim 1, wherein the contacting surface of the board-shaped sport device is electrically conductively connected directly to a second contact element of the coupling device with a cable.

13. The sport system according to claim 1, wherein the first contact element at the shoe is placed or formed in its sole area.

14. The sport system according to claim 1, wherein the first contact element is formed by at least one coupling element placed or formed at the shoe, with this coupling element holding the shoe in the coupled position at the coupling device placed on the board-shaped sport device.

15. The sport system according to claim 1, wherein a ski skin is placed at least in some areas of the board-shaped sport device in an area of the running surface layer that can be turned towards the terrain, with this ski skin being formed electrically conductively at least in part and/or being applied with an electrically conductive skin pile forming the contacting surface.

16. The sport system according to claim 15, wherein the electrically conductive partial section of the ski skin and/or the electrically conductive skin pile is connected electrically conductively to the contacting surface of the board-shaped sport device.

17. The sport system according to claim 15, wherein the electrically conductive partial section of the ski skin and/or the electrically conductive skin pile is directly connected electrically conductively to an application element.

18. The sport system according to claim 1, wherein the board-shaped sport device is chosen from the group consisting of snow shoe, crampon, and skating skid, and wherein at least one partial section of the board-shaped sport device is made of an electrically conductive material and this partial section forms the contacting surface.

19. The sport system according to claim 1, further comprising an outer clothing, wherein the outer clothing has at least one electrically conductive layer or is formed by this at least in sections and wherein this at least one electrically conductive layer is electrically conductively connected to the first contact element placed or formed at the shoe via the discharge path.

20. The sport system according to claim 19, wherein the shoe comprises a solid outer shell and an inner shoe, and wherein the discharge path runs from the outer clothing via an electrically conductively formed footwear or the inner shoe and electrically conductively formed at least in sections towards to the first contact element.

21. The sport system according to claim 19, wherein at least one electrically conductive discharge element is placed or formed in a shoe inside with this discharge element being electrically conductively connected to the first contact element.

22. The sport system according to claim 19, wherein the outer clothing comprises an upper body clothing and a leg clothing and both pieces of clothing have the at least one electrically conductive layer at least in sections, and wherein the upper body clothing is electrically conductively connected to the leg clothing.

23. The sport system according to claim 19, further comprising a finger clothing and wherein the finger clothing comprises at least one electrically conductive layer or is formed by it at least in sections and wherein this at least one electrically conductive layer is electrically conductively connected to the electrically conductively formed layer of the outer clothing.

24. The sport system according to claim 19, further comprising a safety helmet, with the safety helmet comprising an electrically conductive layer at least in sections on its outer surface and/or an electrically conductive layer at least in sections in an area of its head-holding space, and wherein the at least one electrically conductive layer of the safety helmet is connected electrically conductively to the electrically conductive layer of the outer clothing.

25. The sport system according to claim 24, further comprising protection goggles with an electrically conductively formed glasses lace and wherein the glasses lace is electrically conductively connected to the electrically conductive layer placed or formed on the outer surface of the safety helmet.

26. The sport system according to claim 22, wherein the at least one electrically conductive layer of the outer clothing is supported at least in sections by an inner material on an inside that can be turned towards a user.

27. The sport system according to claim 22, wherein the at least one electrically conductive layer of the outer clothing is covered by an outer layer and supported at least in sections by an inner material on an inside facing away from the outer layer.

28. The sport system according to claim 1, wherein the basic body comprises at least one electrically conductive layer at least in sections or is formed by at least one electrically conductive layer at least in sections, and wherein the at least one electrically conductive layer of the basic body is electrically conductively connected to the contacting surface via a discharge path.

29. The sport system according to claim 28, wherein the basic element is made of an electrically conductive material at least in sections and wherein this forms the contacting surface.

30. The sport system according to claim 28, wherein the basic body comprises at least one cladding element and wherein the at least one cladding element has the at least one electrically conductive layer on its outer surface.

31. The sport system according to claim 28, wherein the basic body comprises at least one supporting element for the user or users and wherein the supporting element comprises an electrically conductive layer at a supporting area that can be turned towards the user at least in sections or is formed by an electrically conductive layer at least in sections, with the electrically conductive layer of the supporting element being electrically conductively connected to the contacting surface.

32. The sport system according to claim 28, wherein the basic body is stick-shaped and comprises an additional grip element and a loop, with the grip element and/or loop being formed electrically conductively, and the grip element and/or loop being electrically conductively connected to the contacting surface via a discharge path formed or placed in the basic body.

* * * * *